US011592197B2

(12) United States Patent
Calvanico et al.

(10) Patent No.: US 11,592,197 B2
(45) Date of Patent: Feb. 28, 2023

(54) BOTTOM-MOUNTED WHOLE HOUSE FAN ASSEMBLY

(71) Applicant: Solatube International, Inc., Vista, CA (US)

(72) Inventors: John Paul Calvanico, Oceanside, CA (US); David Winsor Rillie, Vista, CA (US); Tyler Brinkman, Vista, CA (US)

(73) Assignee: Solatube International, Inc., Vista, CA (US)

( * ) Notice: Subject to any disclaimer, the term of this patent is extended or adjusted under 35 U.S.C. 154(b) by 501 days.

(21) Appl. No.: 16/515,663

(22) Filed: Jul. 18, 2019

(65) Prior Publication Data

US 2020/0103129 A1 Apr. 2, 2020

Related U.S. Application Data

(63) Continuation-in-part of application No. 16/145,970, filed on Sep. 28, 2018, now abandoned.

(51) Int. Cl.
*F24F 7/02* (2006.01)
*F04D 29/64* (2006.01)
(Continued)

(52) U.S. Cl.
CPC ..... *F24F 7/025* (2013.01); *F04D 29/646* (2013.01); *F24F 7/065* (2013.01);
(Continued)

(58) Field of Classification Search
CPC combination set(s) only.
See application file for complete search history.

(56) References Cited

U.S. PATENT DOCUMENTS 2,626,742 A * 1/1953 Turner ..... F04D 29/646 416/500
2,830,779 A * 4/1958 Wentling ..... F04D 29/601 280/47.24
(Continued)

FOREIGN PATENT DOCUMENTS

DE 202008012984 U1 1/2009
EP 0277497 B1 5/1991
(Continued)

OTHER PUBLICATIONS

"QC" (QC Manufacturing, "How to Install QuietCool Whole House Fans", Posted Feb. 2, 2018, Youtube, URL: https://www.youtube.com/watch?v=PqNR4m0lHaw) (Year: 2018).*
(Continued)

*Primary Examiner* — Allen R.B. Schult
(74) *Attorney, Agent, or Firm* — John L. Rogitz

(57) ABSTRACT

A bottom-mounted whole house fan assembly includes an intake plenum mounted over an opening in a ceiling of a building. The intake plenum is supported on the ceiling in the attic of the building. One end of a flexible duct is connected to the intake plenum and the other end of the duct is connected to a fan so that the fan draws air in the building through the intake plenum and duct and exhausts the air in the attic from whence the air is vented to atmosphere. The fan is supported by at least one vertical strut that is connected to the ceiling at the lower end of the strut and to a housing of the fan at the upper end of the strut. A sound dampener is interposed between the strut and the fan housing and/or the ceiling beam to which the strut is attached.

18 Claims, 20 Drawing Sheets

(51) Int. Cl.
*F24F 13/24* (2006.01)
*F24F 13/02* (2006.01)
*F24F 7/06* (2006.01)

(52) U.S. Cl.
CPC ..... *F24F 13/0218* (2013.01); *F24F 13/0254* (2013.01); *F24F 13/24* (2013.01); *F24F 2013/242* (2013.01)

(56) References Cited

U.S. PATENT DOCUMENTS

| | | | | | |
|---|---|---|---|---|---|
| 2,868,558 | A | * | 1/1959 | Krauss | F04D 29/646 280/47.131 |
| 3,096,933 | A | * | 7/1963 | Bora | F04D 29/646 417/247 |
| 3,405,894 | A | * | 10/1968 | Jordan | F04D 29/646 416/246 |
| 4,388,784 | A | | 6/1983 | Jentoft et al. | |
| 4,685,256 | A | | 8/1987 | Alkjaer | |
| 4,715,502 | A | * | 12/1987 | Salmon | H04Q 1/09 211/175 |
| 4,750,302 | A | | 6/1988 | Bechtold | |
| 4,788,804 | A | | 12/1988 | Haas | |
| 4,823,525 | A | | 4/1989 | Roberts et al. | |
| 4,833,838 | A | | 5/1989 | Van Dame | |
| 4,966,819 | A | | 10/1990 | Schatz et al. | |
| 5,502,935 | A | | 4/1996 | Demmer | |
| 5,522,189 | A | | 6/1996 | Mortensen et al. | |
| 5,561,952 | A | | 10/1996 | Damron | |
| 5,913,779 | A | | 6/1999 | Edvardsen | |
| 6,164,025 | A | | 12/2000 | Lindgren | |
| 6,212,834 | B1 | | 4/2001 | Lindgren | |
| 6,219,977 | B1 | | 4/2001 | Chao et al. | |
| 6,263,624 | B1 | | 7/2001 | Hoy et al. | |
| 6,503,601 | B1 | | 1/2003 | Edvardsen | |
| 6,695,692 | B1 | | 2/2004 | York | |
| 6,877,282 | B2 | | 4/2005 | Melsen et al. | |
| 6,918,216 | B2 | | 7/2005 | Hoy et al. | |
| 7,185,464 | B2 | | 3/2007 | Bracale | |
| 7,296,388 | B2 | | 11/2007 | Valentz et al. | |
| 7,351,296 | B2 | | 4/2008 | Waggoner et al. | |
| 7,497,774 | B2 | | 3/2009 | Stevenson et al. | |
| 7,607,266 | B2 | | 10/2009 | D'Hagin | |
| 8,292,706 | B2 | | 10/2012 | Møller et al. | |
| 8,555,571 | B2 | | 10/2013 | Darmer et al. | |
| 8,720,135 | B2 | | 5/2014 | Sønderkaer et al. | |
| 8,896,924 | B2 | | 11/2014 | Weaver | |
| 8,998,691 | B1 | | 4/2015 | Stevenson | |
| 9,903,603 | B2 | | 2/2018 | Stevenson | |
| 10,024,061 | B2 | | 7/2018 | Ainger | |
| 10,371,397 | B1 | | 8/2019 | Stevenson | |
| 10,739,025 | B1 | | 8/2020 | Stevenson | |
| 10,753,627 | B1 | | 8/2020 | Stevenson | |
| 10,830,464 | B1 | | 11/2020 | Stevenson | |
| 2004/0074156 | A1 | | 4/2004 | Haynes | |
| 2005/0000173 | A1 | | 1/2005 | Lindgren et al. | |
| 2005/0081462 | A1 | | 4/2005 | Mulford et al. | |
| 2005/0086878 | A1 | | 4/2005 | Feucht et al. | |
| 2009/0272047 | A1 | | 11/2009 | Gottler | |
| 2010/0269426 | A1 | | 10/2010 | Richter et al. | |
| 2012/0174506 | A1 | | 7/2012 | Buckley et al. | |
| 2014/0206278 | A1 | | 7/2014 | Stevenson | |
| 2015/0128516 | A1 | | 5/2015 | Valencia et al. | |
| 2017/0275876 | A1 | | 9/2017 | Mucha et al. | |
| 2021/0156582 | A1 | | 5/2021 | Stevenson et al. | |

FOREIGN PATENT DOCUMENTS

| | | | |
|---|---|---|---|
| EP | 0389058 | B1 | 6/1992 |
| EP | 0756659 | B1 | 11/1999 |
| EP | 0760043 | B1 | 1/2000 |
| EP | 0792977 | B1 | 5/2003 |
| EP | 1203129 | B1 | 11/2005 |
| EP | 1424455 | B1 | 7/2006 |
| EP | 1756481 | B1 | 7/2008 |
| EP | 1756482 | B1 | 7/2008 |
| EP | 1311732 | B1 | 5/2009 |
| EP | 1281821 | B1 | 6/2010 |
| EP | 2208834 | A2 | 7/2010 |
| EP | 2242889 | A1 | 10/2010 |
| EP | 2305915 | A2 | 4/2011 |
| EP | 1485547 | B1 | 10/2011 |
| EP | 2508690 | A1 | 10/2012 |
| EP | 2626482 | A1 | 8/2013 |
| EP | 2749706 | A1 | 7/2014 |
| EP | 2749707 | A1 | 7/2014 |
| EP | 2231956 | B1 | 8/2015 |
| EP | 2927387 | A1 | 10/2015 |
| EP | 2947226 | A1 | 11/2015 |
| EP | 1896673 | B1 | 4/2016 |
| EP | 3015617 | A1 | 5/2016 |
| EP | 2077302 | B1 | 8/2016 |
| EP | 3133222 | A1 | 2/2017 |
| EP | 3181777 | A1 | 6/2017 |
| EP | 2481864 | B1 | 7/2017 |
| EP | 2947227 | B1 | 4/2018 |
| EP | 3199718 | B1 | 5/2018 |
| EP | 3323957 | A1 | 5/2018 |
| FR | 2735047 | B1 | 8/1997 |
| GB | 2400885 | B | 8/2006 |
| NL | 2006780 | | 11/2012 |
| PL | 382913 | B | 7/2014 |
| PL | 403358 | A1 | 10/2014 |
| PL | 392795 | B | 10/2016 |
| PL | 400174 | B | 6/2017 |

OTHER PUBLICATIONS

"Patterson" (Patterson Fan Company, Inc, "Industrial Fans Mounting Options", From Mar. 14, 2015, URL: https://www.pattersonfan.com/mounting-options.html) (Year: 2015).*

"Patterson" (Patterson Fan Company, Inc, "Pedestal Base Assembly", provided as supporting documentation, URL: https://www.pattersonfan.com/uploads/2/9/7/4/29747215/pb_assembly.pdf) (Year: 2021).*

*QC Manufacturing, Inc.* v. *Solatube International, Inc. et al.,* Case No. 8:18-cv-00540-DOC(JDEx) (C.D. Cal. filed Mar. 29, 2018).

* cited by examiner

BOTTOM-MOUNTED WHOLE HOUSE FAN ASSEMBLY

FIELD

The application relates generally to whole house fan (WHF) assemblies, and more particularly to bottom mounted WHF assemblies.

BACKGROUND

Whole house fans (WHF) are used to draw hot air from a house into the attic by means of a fan, with the hot air being exhausted out of the attic grates. Cooler air from outside is drawn into the house through an open door or window to provide for natural ventilation without the expense of an air conditioning compressor.

WHFs have been provided that are suspended from roof rafters. As understood herein, this design, in attempt to dampen vibration from the fan for sound quieting, poses several technical problems and drawbacks.

SUMMARY

Accordingly, in one aspect an assembly includes at least one fan housing, at least one fan mounted in the fan housing, and at least one intake plenum configured to be mounted on at least one structure of a ceiling in a building above an opening of the ceiling. At least one air duct is configured for connecting the fan housing to the intake plenum such that the fan when energized can draw air in through the opening of the ceiling, the intake plenum, and the duct and exhaust air into an attic of the building. The assembly also includes at least one strut configured for vertical mounting on structure of the ceiling at a lower end of the at least one strut and to the fan housing at an upper end of the at least one strut.

In some implementations, the air duct may be flexible. The air duct may also have a first end connectable to the intake plenum and a second end connectable to the fan housing so that the fan when connected to the air duct may draw air in the building through the intake plenum and duct and exhaust the air in the attic. Also, in some implementations, the assembly may include a sound dampener interposed between the at least one strut and the fan housing, and/or interposed between the at least one strut and structure of the ceiling to which the at least one strut is mounted.

Furthermore, in some examples the assembly may include at least one arcuate collar that may be configured to be engaged with a top portion of the at least one strut. In these examples, the arcuate collar may be spaced from the fan housing along at least a segment of the collar and may be coupled to the fan housing by respective first and second couplings at opposed ends of the collar.

Also, in some examples, the assembly may include at least first and second struts, where each of the first and second struts may be configured for vertical mounting to structure of the ceiling. In these examples, the assembly may also include a first non-rigid connector configured for attachment to the first strut and to the fan housing to suspend the fan housing from the first strut, as well as a second non-rigid connector configured for attachment to the second strut and to the fan housing to suspend the fan housing from the second strut. Thus, if desired in these examples the assembly may further include a first ear hook configured for attachment to the fan housing and configured for connection to the first strut via the first non-rigid connector, as well as a second ear hook configured for attachment to the fan housing and configured for connection to the second strut via the second non-rigid connector. The first non-rigid connector may include a first strap, cable, and/or wire that is configured for attachment to an upper surface of the first strut, while the second non-rigid connector may include a second strap, cable, and/or wire that is configured for attachment to an upper surface of the second strut. Still further, if desired the assembly may include at least one crossbar configured for horizontal mounting on structure of the ceiling and configured to vertically mount the first and second struts on structure of the ceiling.

In another aspect, an assembly includes an intake plenum mountable over an opening in a ceiling of a building to be supported on one or more ceiling beams in an attic of the building. The assembly also includes a flexible duct having a first end connectable to the intake plenum and a second end connectable to housing of a fan so that the fan when connected to the duct draws air in the building through the intake plenum and duct and exhausts the air into the attic. The assembly further includes at least one strut configured for vertical connection to a ceiling beam or support surface at a lower end of the strut and to the housing of the fan at an upper end of the strut. The assembly also includes a sound dampener interposed between the strut and the fan housing, and/or between the strut and the ceiling beam or support surface to which the strut is attached.

If desired, in some examples the sound dampener may include at least one collar engageable with the upper end of the strut, with the collar being engageable with the housing at opposing ends of the collar and being spaced from the housing while engaged with the housing. Also, in some examples, the collar may include an inner band and an outer band generally parallel to the inner band and spaced from the inner band along at least a segment of the collar.

In some implementations, the sound dampener may include at least one resilient grommet. Also, in some implementations, the strut may include a first segment and a second segment slidably engaged with the first segment in a first configuration and not slidably engaged with the second segment in a second configuration. The second segment may include a U-shaped channel configured for receiving the first segment and may include plural bendable tabs on a bottom end of the second segment for flush engagement with the structure of the ceiling.

In still another aspect, an assembly includes at least one fan housing, at least one fan mounted in the fan housing, at least one intake plenum configured to be mounted on at least one structure of a ceiling in a building above an opening of the ceiling, and at least one air duct configured for connecting the fan housing to the intake plenum such that the fan when energized can draw air in through the opening of the ceiling, the intake plenum, and the duct and exhaust air into an attic of the building. The assembly also includes at least a first strut configured for vertical mounting on structure of the ceiling, at least a first non-rigid connector configured for attachment to the first strut and to the fan housing to suspend the fan housing from the first strut, at least a second strut configured for vertical mounting on structure of the ceiling, and at least a second non-rigid connector configured for attachment to the second strut and to the fan housing to suspend the fan housing from the second strut.

In some examples, the first and second non-rigid connectors may respectively include one or more straps, cables, and/or wires that may be configured for respective attachment to the first and second struts. The first and second non-rigid connectors may even be configured for attachment to the fan housing via respective ear hooks coupled to the fan housing, and each of the first and second non-rigid connectors may be configured to establish a loop that engages a respective ear hook coupled to the fan housing.

Still further, in some implementations the assembly may include a crossbar. The crossbar may be configured for mounting on structure of the ceiling and configured to vertically mount the first and second struts on structure of the ceiling.

In still another aspect, a method includes vertically mounting at least one post on a ceiling structure in an attic, engaging the at least one post with a housing of a fan, and dampening at least some vibration from the fan from propagating to the post.

The details of the present application, both as to structure and operation, can best be understood in reference to the accompanying drawings, in which like reference numerals refer to like parts, and in which:

DETAILED DESCRIPTION

Figure 1:
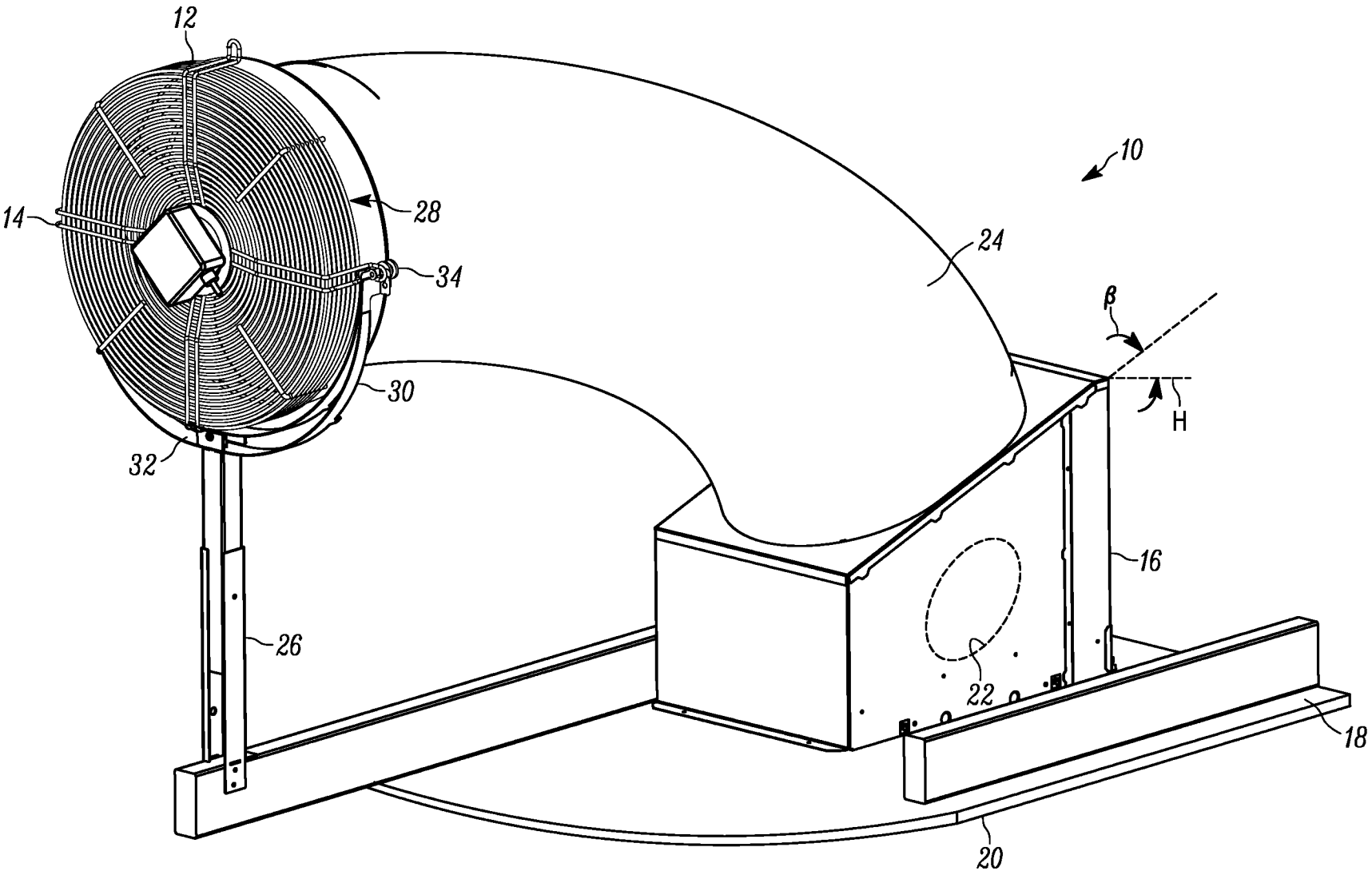
FIG. 1 is a perspective of a whole house fan (WHF) assembly consistent with present principles, with the ceiling opening shown in phantom.

FIG. 1 illustrates an assembly 10 that includes a fan housing 12 and a fan 14 mounted in the fan housing 12 for rotation of the fan blades therein. The assembly also includes an intake plenum 16 such as a damper that is mounted in an attic 18 on structure (such as a ceiling joist or support) of a ceiling 20 in a building above an opening 22 of the ceiling. In some embodiments the plenum 16 may rest on the top of the ceiling drywall or other portions of the attic floor between the beams and can be mechanically secured to at least one beam or other portion of the attic floor.

An air duct 24, which may be flexible, which may be thermally insulated, and which may be acoustically insulated, connects the fan housing 12 to the intake plenum 16 such that the fan 14 when energized draws air in through the opening 22 of the ceiling, the intake plenum 16, and the duct 24, exhausting the air into the attic 18 from whence the air may be vented through roof vents to atmosphere.

The assembly 10 also includes at least one start 26 configured for vertical mounting on structure of the ceiling/attic floor. Consistent with present principles, at least one arcuate collar 28 is configured to be engaged with a top portion 30 of the strut 26, with the arcuate collar 28 being spaced from the fan housing 12 as shown along at least a segment 32 of the collar and coupled to the fan housing 12 by respective dampening couplings 34 at opposed ends of the collar and by a third dampening coupling at the strut-housing interface, it being understood that the resilient members of the dampening couplings are substantially identical in configuration and operation.

Figure 3:
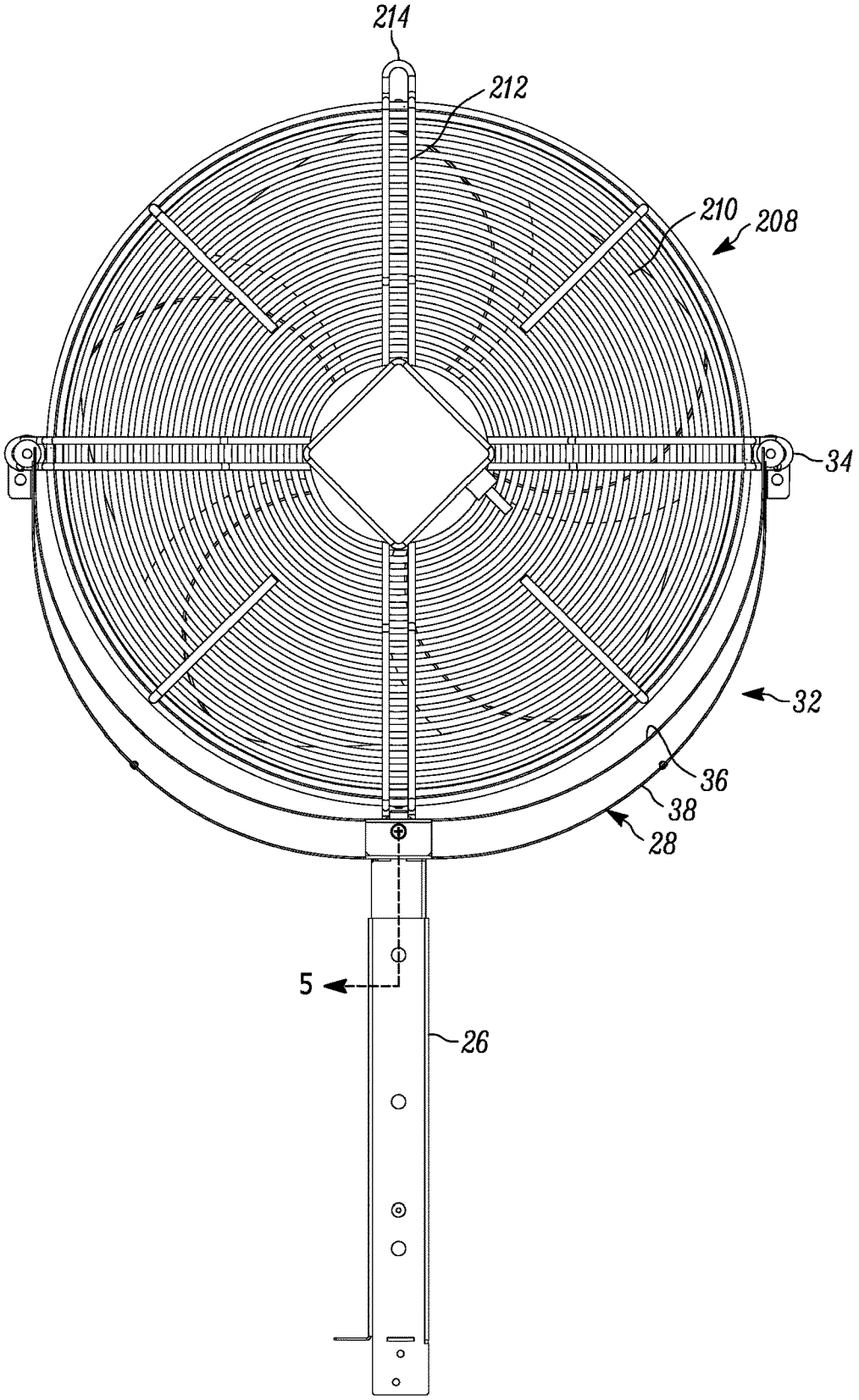
FIG. 3 is a front elevational view of the fan housing shown in FIG. 1 mounted on the strut.

Referring briefly to FIG. 3, the collar 28 includes an arcuate inner band 36 and an arcuate outer band 38 that is generally parallel to the inner band 36 and that is spaced from the inner band 36 along the segment 32 of the collar. Essentially, the bands 36, 38 are spaced from each other and are not coupled to each except at the side and bottom couplings 34 as more fully described below, to provide for additional vibration dampening.

Because the side couplings 34 are located slightly rearward (relative to the direction of fan exhaust) relative to the bottom coupling 34 on the fan housing 12, the front of the fan housing 12 tilts slightly downward relative to the horizontal axis "H" at an angle $\alpha$ of, e.g., one to fifteen degrees, meaning the rear of the fan housing tilts slightly up. An oblique angle $\beta$ is established with respect to the horizontal by the top surface of the damper 16 and the damper 16 oriented with its top surface tilted slightly toward the fan as shown. With the slight upward tilt of the rear of the fan housing that connects to the duct 24 and the described tilt of the top surface of the damper 16 which also connects to the duct 24, bends of the duct 24 are lessened.

FIGS. 2-6 illustrate details on a dampening coupling consistent with present principles. In the example shown, the strut through the collar 28, is coupled to the fan housing 12 using three dampening couplings 34, two at the opposed ends of the generally semi-circular collar 28 and one at the strut 26. The dampening couplings 34 include respective resilient members and are configured such that no metal-to-metal contact exists between the collar 28 and the fan housing 12.

Figure 2:
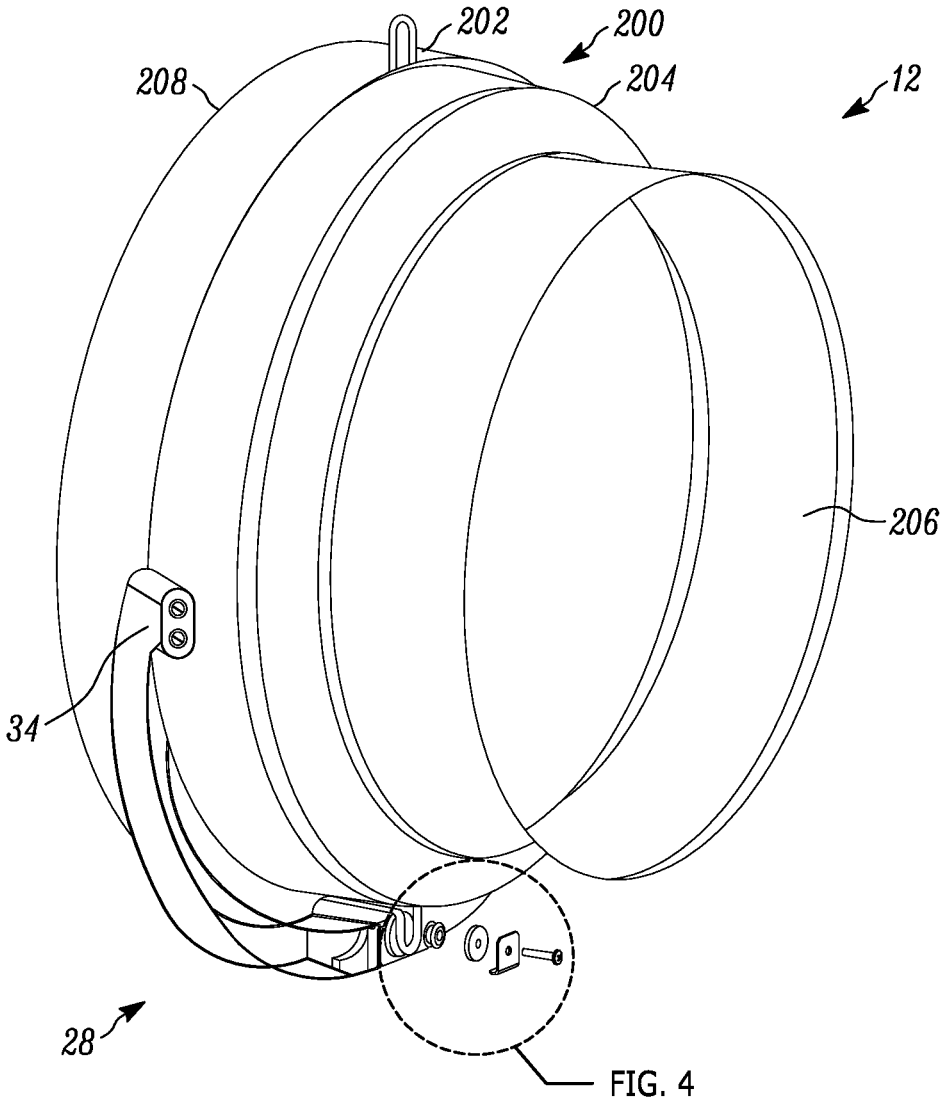
FIG. 2 is a perspective view of the fan housing shown in FIG. 1.

As shown in FIG. 2, the example fan housing 12 includes an annular continuous shroud 200 in which the fan (not shown in FIG. 2) is disposed. The shroud 200 may include a cylindrical exhaust segment 202 at the end of the housing 12 through which the fan exhausts air, and a frustum-shaped segment 204 tapering radially inward from the cylindrical exhaust segment 202 to merge with a cylindrical intake segment 206 which is coupled to the duct 24 shown in FIG. 1.

The fan housing 12 may also include a grill 208 that covers the exhaust end defined by the cylindrical exhaust segment 202. As shown in FIG. 3, the grill 208 includes a grid 210 of concentric circular bars supported by four straight radial bar pairs 212, with each radial bar pair 212 terminating in a respective hollow ear 214 that extends radially beyond the grid 210, with the left, right, and bottom ears establishing a portion of the respective three collar-to-fan housing couplings 34.

Each coupling 34 includes a resilient member made of one or more pieces of deformable, resilient rubber or plastic. In the example shown and now referring to FIGS. 4 and 5, each coupling 34 includes a rubber grommet 216 that is received within the respective ear 214 of the grill 208. The example grommet 216 is configured with a relatively smaller narrow middle portion as shown and larger end disks that are larger than the ear 214, so that one of the end disks can be deformed by pushing the end disk through the opening of the ear 214 until it clears the opening and returns to its materially biased larger disk-like shape, with the narrow middle portion disposed in the ear 214 and the opposed larger end disks of the grommet disposed on either side of the ear 214.

Figure 5:
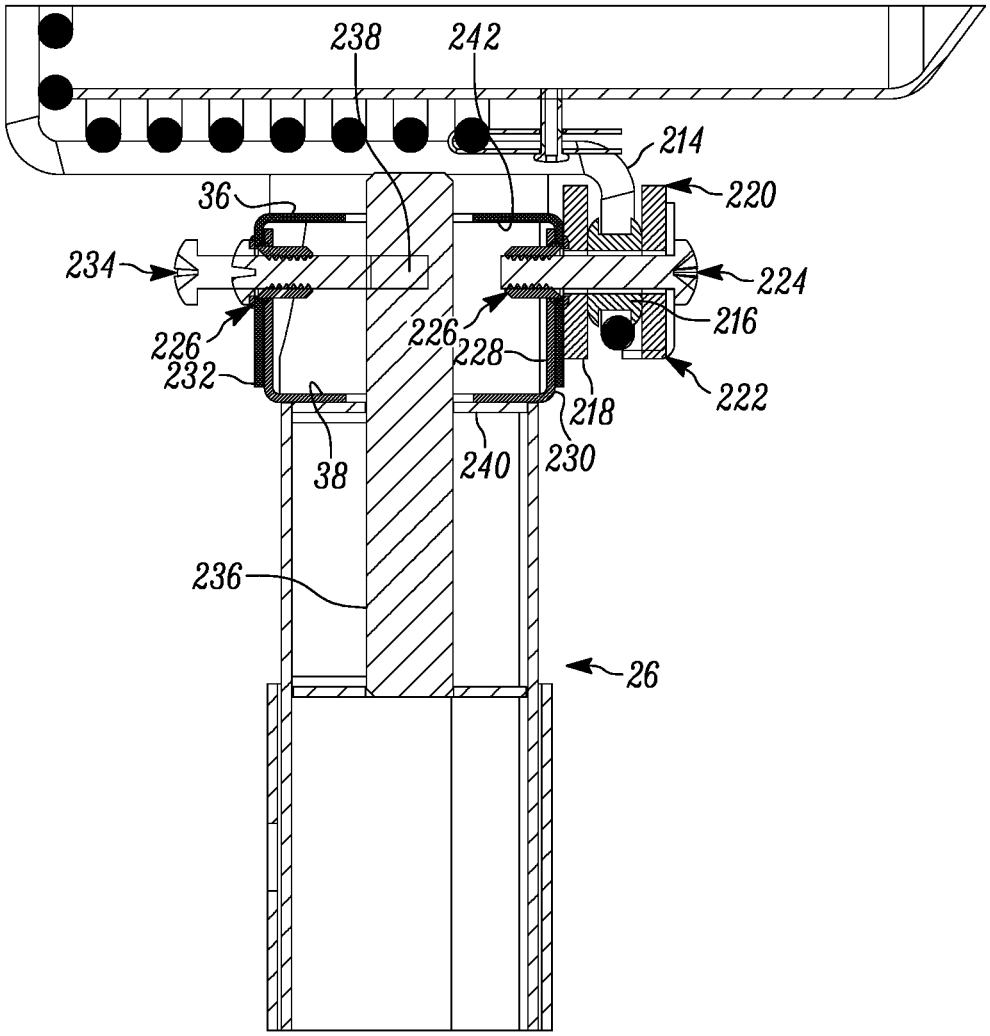
FIG. 5 is a cross-sectional view as taken along the line "5" in FIG. 3.

In addition to the grommet 216, inboard and outboard resilient, preferably rubber cushioning washers 218, 220 straddle the end disks of the grommet 216. One or both washers 218, 220 may have a respective metal support washer or clip 222 on the side of the washer that is opposed to the grommet 216, so that a fastener such as a screw can pass through the support clips 222, washers 218, 220, and grommet 216 and engage, e.g., a nut 226 (FIG. 5). If desired, the grommet 216 and rubber washers 218, 220 may be made of a single piece of unitary molded material.

Figure 4:
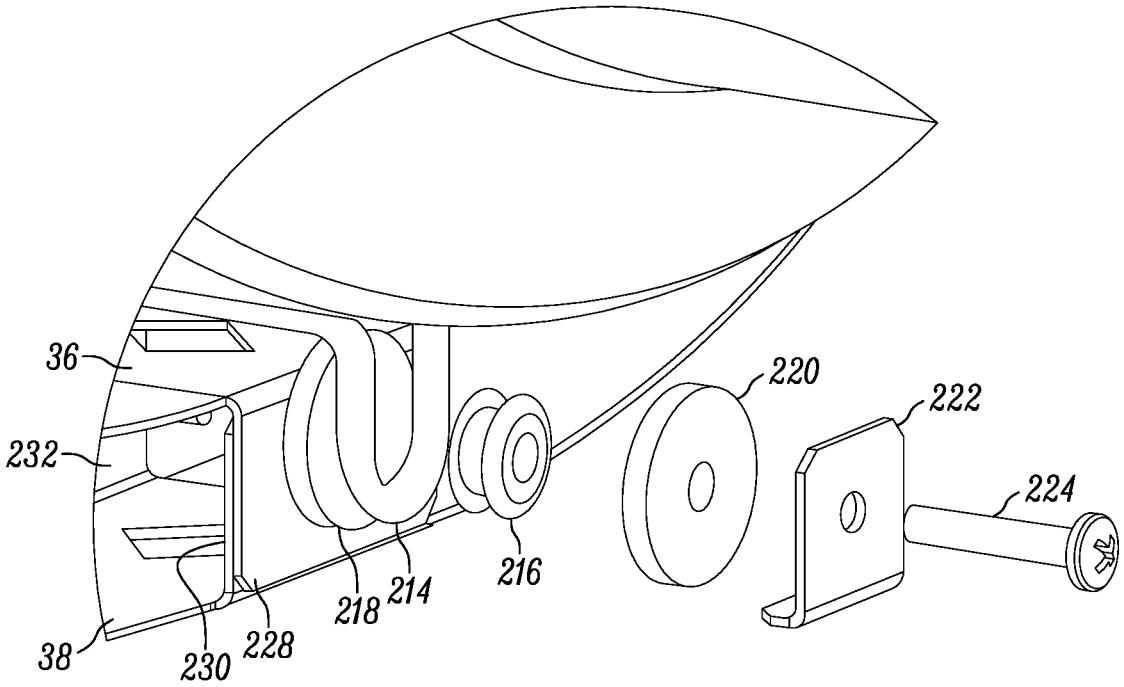
FIG. 4 is an exploded perspective detail view of the dampening coupling at the strut as indicated by the numeral "4" in FIG. 2.

Note that the outer clip 222 as best shown in FIG. 4 is L-shaped with the bight formed by the "L" facing the washer 220. This L-shaped clip 222 serves to interlock with the coupling structure on the grill to prevent slippage at the lower coupling owing to the weight of the fan above the coupling.

FIGS. 4 and 5 show the bottom coupling 34 while FIG. 6, discussed further below, shows an example side coupling. As perhaps best shown in FIG. 4, at the bottom coupling 34, the inner band 36 includes a rear tab 228 that is bent approximately ninety degrees from the plane defined by the inner band at that point. The outer band 38 similarly comprises a rear tab 230 that is bent approximately ninety degrees from the plane defined by the outer band at that point, with the rear tabs 228, 230 being flush together and held between the inboard washer 218 and nut 226 (FIG. 5), clamping the collar 28 to the grill 208 at the lower coupling 34.

At least the outer band 38 may also include a front tab 232 parallel to the rear tab 230, and if desired the inner band 36 likewise may include a front tab parallel to its rear tab and flush against the front tab 232 of the outer band 38. As best shown in FIG. 5, a set screw 234 may extend through the front tabs into a lateral channel 238 of a post 236 of the strut 26. The post 236 extends through lower and upper openings 240, 242 of the respective outer and inner bands 38, 36 and is held in place by the set screw 234 to couple the strut 26 to the collar 28 with the end of the post 236 being slightly spaced from the grill 208 and thus not touching structure on the fan housing. Alternatively, the post 236 may extend through at least one opening being formed in a connector band that is itself coupled to the inner and outer bands 36, 38, where the connector band may be coupled to the fan housing 12.

The shroud 200, grill 208, strut 26, and collar 28 typically are made of metal, although other materials such as hard plastic or composite materials may be used.

Figure 6:
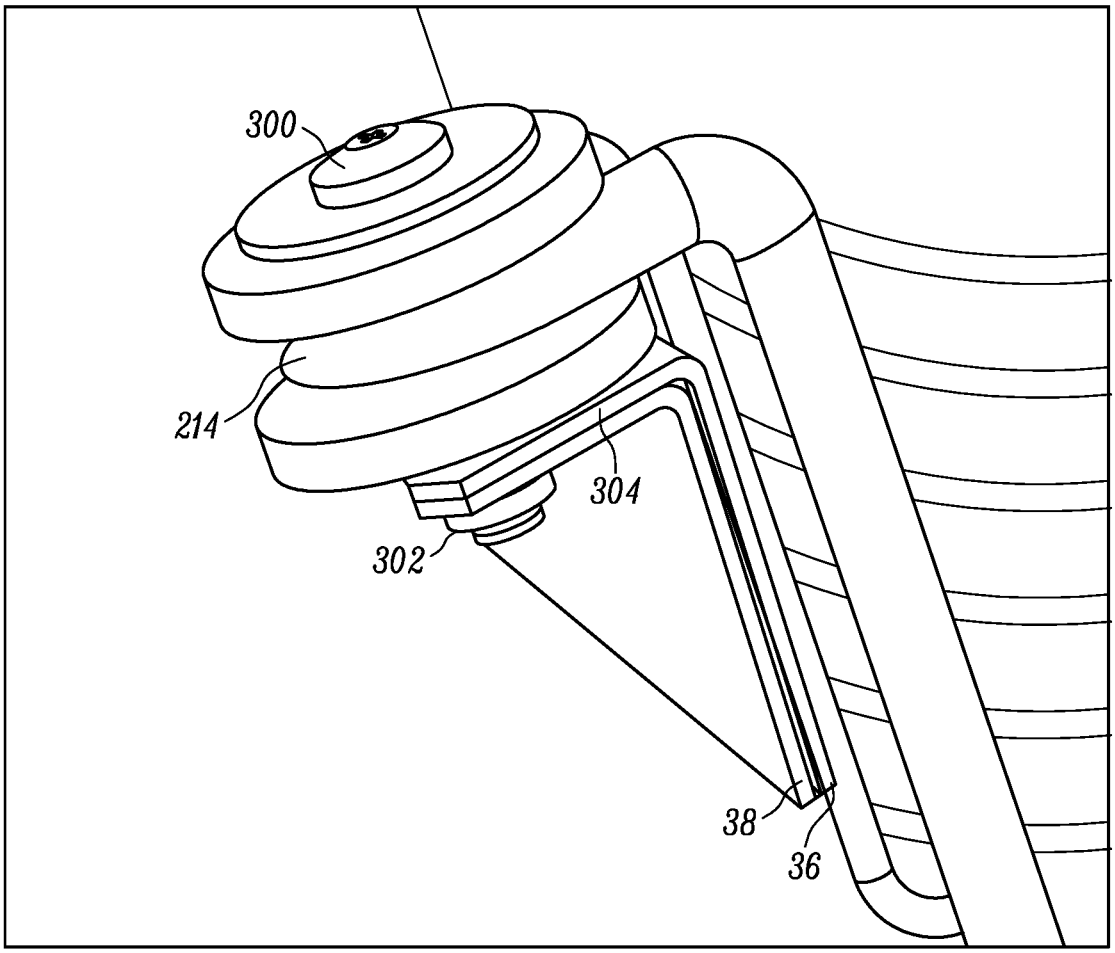
FIG. 6 is a detail perspective view of one of the side couplings.

FIG. 6 illustrates a coupling 34 at the side of the fan assembly (one coupling 34 at each side as shown in 3). A grommet (not shown in FIG. 6) is received in an ear 214 of the grill 208 and is straddled by resilient washers that in turn may be supported by metal washers through which a bolt 600 extends to engage a nut 302, with tabs 304 of the inner and outer band 36, 38 being flush with other, sandwiched between the nut 302 and lower washer. The grommet and washers in FIG. 6 are substantially identical in configuration and operation to those shown and described above in FIGS. 2-5.

Figure 7:
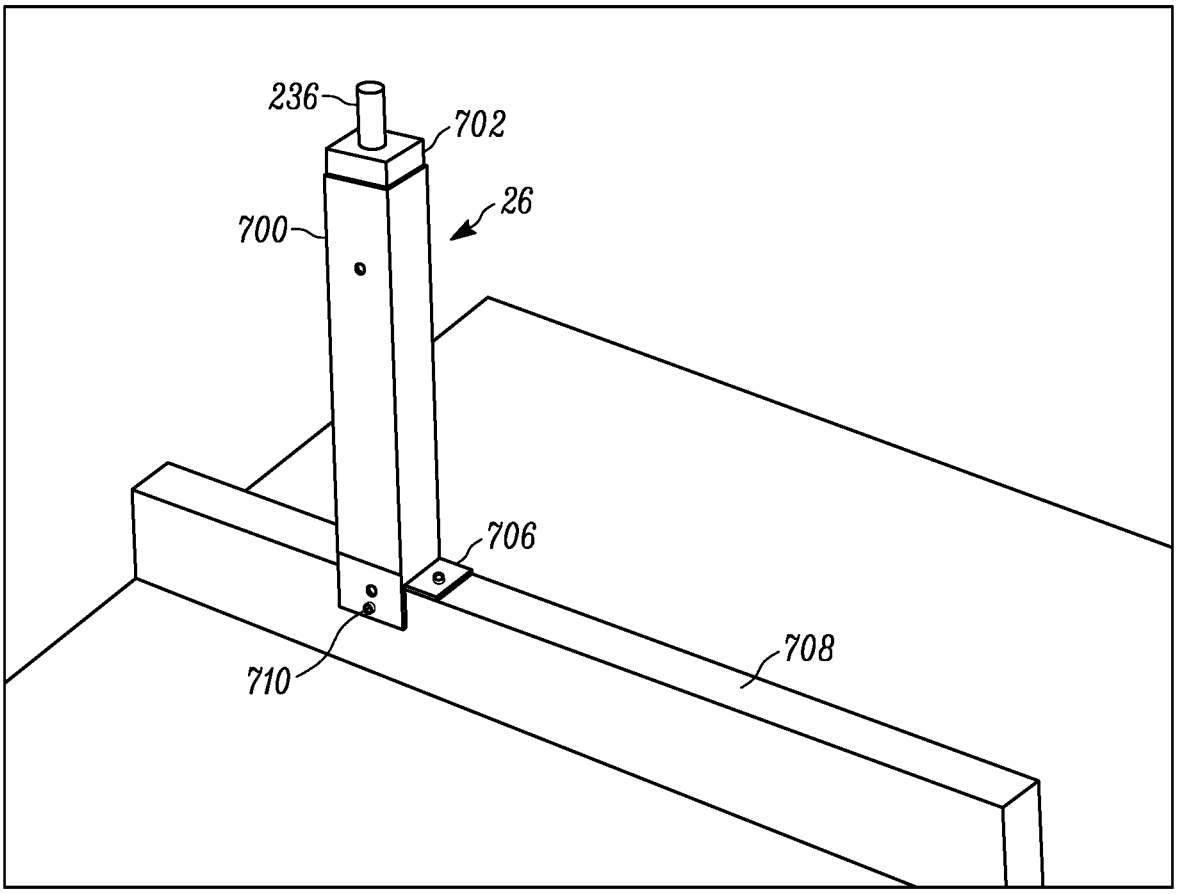
FIGS. 7-10 are perspective views of the strut showing example ways to mount the strut on ceiling structure in the attic.
Figure 8:
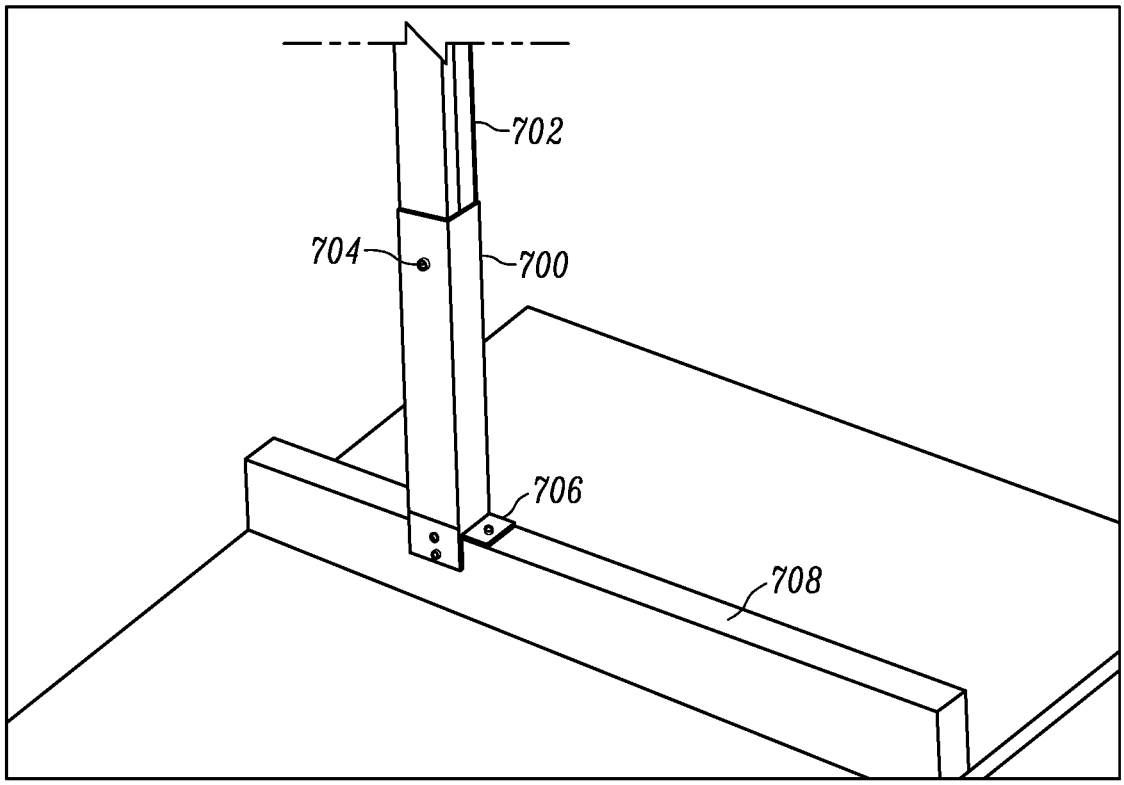

Now referring to FIGS. 7 and 8, in some implementations the strut may include an outer segment 700 that may be U-shaped in transverse cross-section and an inner segment 702 slidably engaged with the outer segment in a first configuration (FIG. 7) slidably engaged with the outer segment in a second configuration (FIG. 8). A set pin 704 may extend through holes in the segment 700, 702 that register with each other to hold the strut 26 in the extended configuration shown in FIG. 8.

Figure 9:
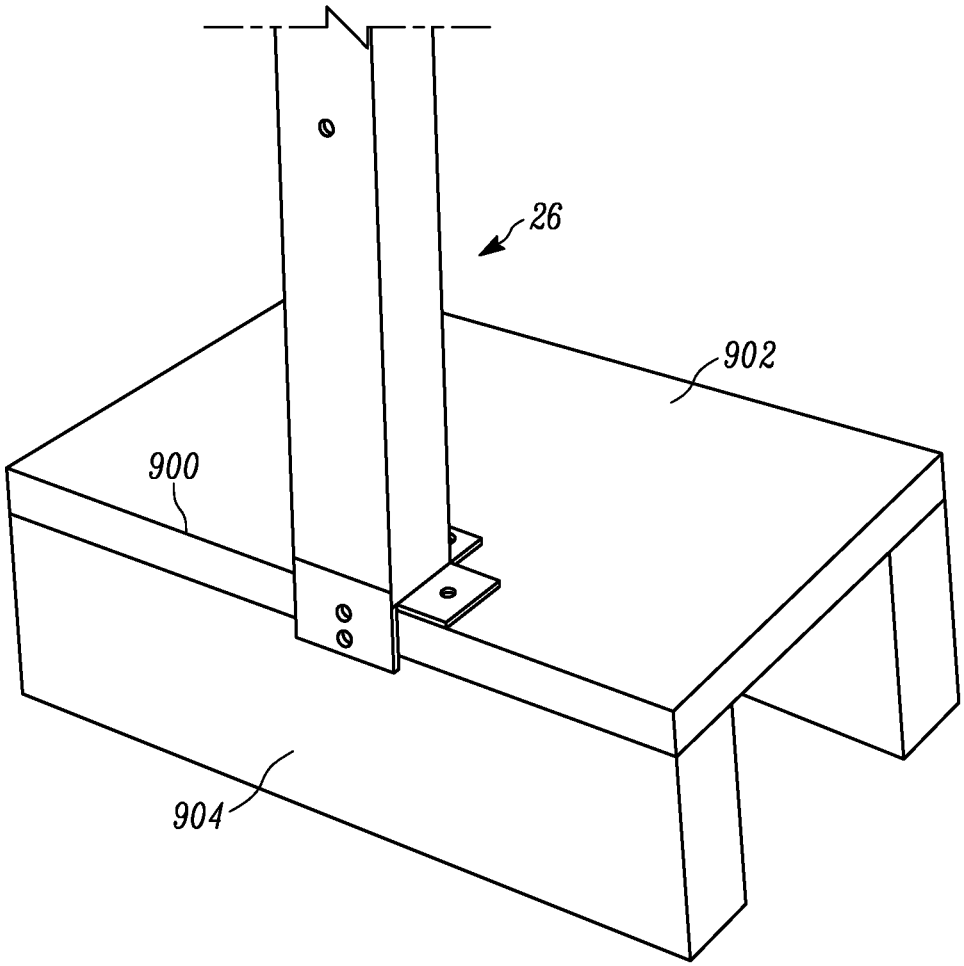
Figure 10:
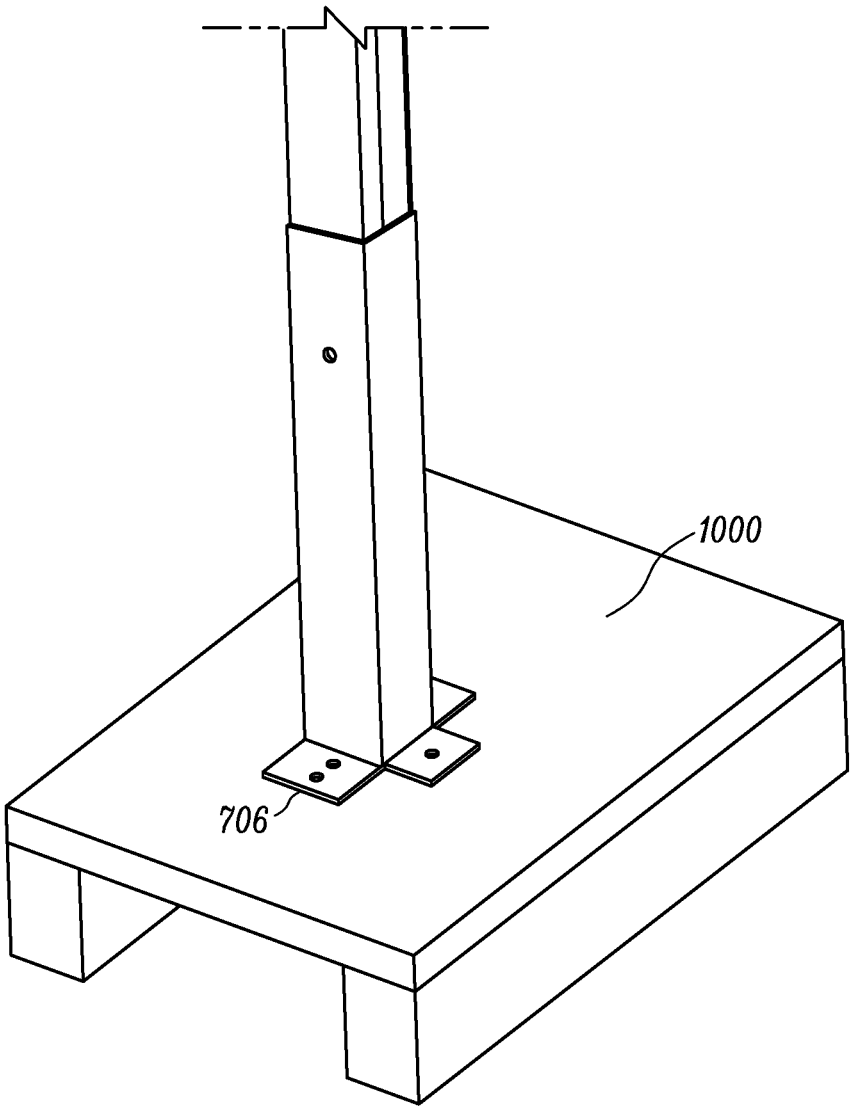

In examples, plural bendable tabs 706 may be provided on a bottom end of the outer segment 700 for flush engagement with the structure of the ceiling/attic floor, in the example shown, with a ceiling joist 708. Each tab 706 may be formed with two screw holes 710, with the proximal screw hole being engaged with a screw to fasten the strut to the joist 708 in FIGS. 7 and 8 and with the distal screw hole being used for other mount types. For example, referring briefly to FIG. 9, the strut 26 may be mounted on an edge 900 with two tabs 706 bent to rest on a horizontal surface 902 and one tab 706 left unbent to be flush a vertical side 904 of the mount, with the distal screw holes being used for fasteners that engage the horizontal surface 902. In FIG. 10, all three tabs 706 are bent to be flush with a horizontal mount 1000.

In some examples and referring back to FIG. 7, the inner segment 702 of the strut can include a lower cross-sectional size and an upper cross-sectional size established by the post 236, with the upper cross-sectional size being smaller than the lower cross-sectional size. If desired, the post 236 and top portion of the inner segment 702 may be established by a plastic plug, with plastic plates (not shown) being engaged with the portion of the collar 26 that receives the post, to further provide for vibration dampening.

Figure 11:
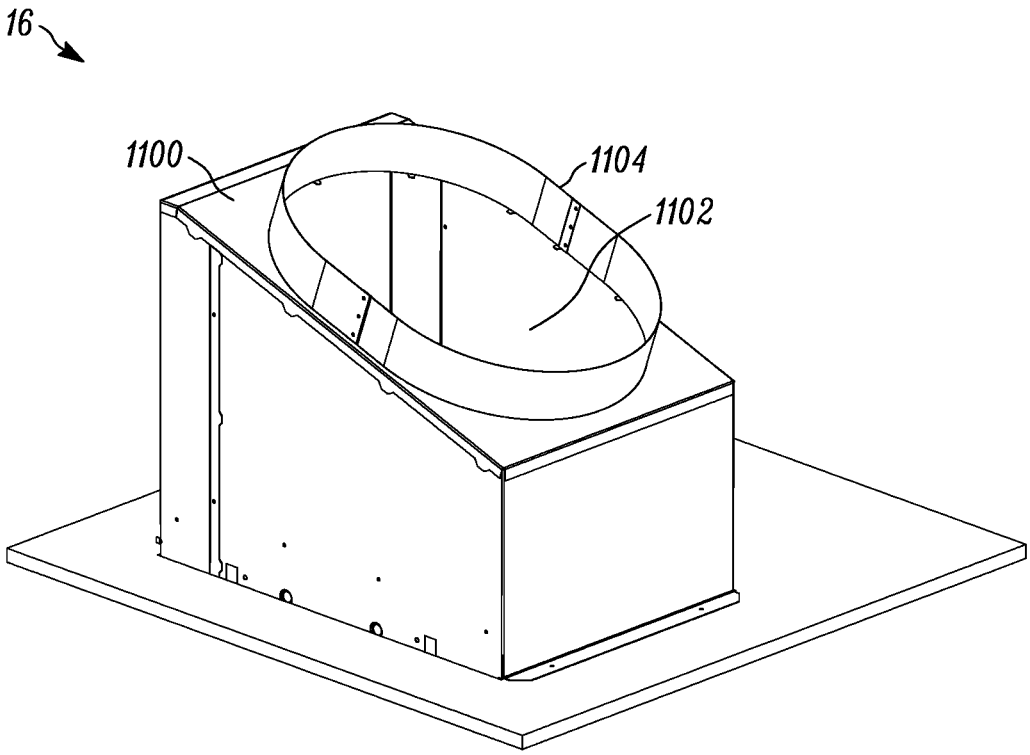
FIG. 11 is a perspective view of the damper.

FIG. 11 shows the damper 16 with top surface 1100 that is angled obliquely as described above with respect to the horizontal. The damper 16 is hollow except for the oblique top surface is generally parallelepiped-shaped. Preferably the damper 16 is oriented toward the fan housing such that the top surface 1100 is tilted toward the fan housing for reasons described previously. An opening 1102 bordered by a cylindrical curb 1104 may be centrally formed in the top surface with the curb 1104 extending above to the surface 1100 to join the duct 24.

Figure 12:
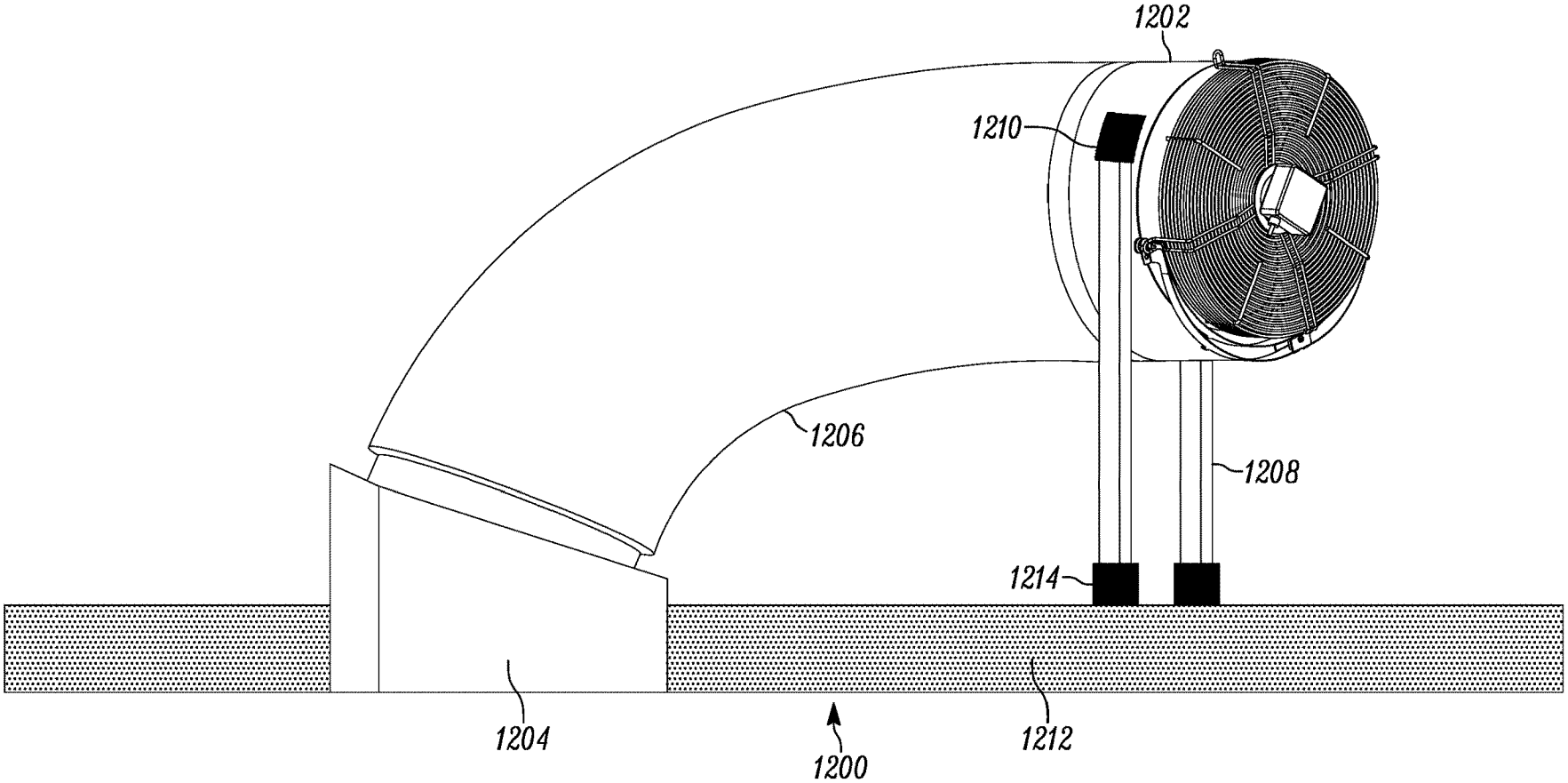
FIG. 12 is a diagram of an alternate embodiment.

FIG. 12 shows a bottom-mounted attic whale house fan assembly 1200 with a fan and housing 1202 that are substantially identical in configuration and operation to those described above drawing air in through a damper 1204 and ducting 1206, also substantially identical in configuration and operation to those described above. However, in the embodiment shown in FIG. 12 left and right struts 1208 support opposed sides of the fan housing at respective left and right upper couplings 1210 (only one upper coupling shown in the perspective of FIG. 12). The couplings 1210 may be substantially identical in configuration and operation to those described above or may be configured according to the description of FIGS. 13 and 14 below.

Also, FIG. 12 shows that if desired, the struts 1208 may be supported on structure 1212 of the ceiling/attic floor by respective lower couplings 1214 which may be resilient or otherwise vibration-dampening. For example, the lower couplings 1214 may be rubber bushings with cavities that receive the respective struts 1208 therein with the bottom of each cavity being interposed between the bottom of the strut and the structure 1212 on which the strut is supported.

Figure 13:
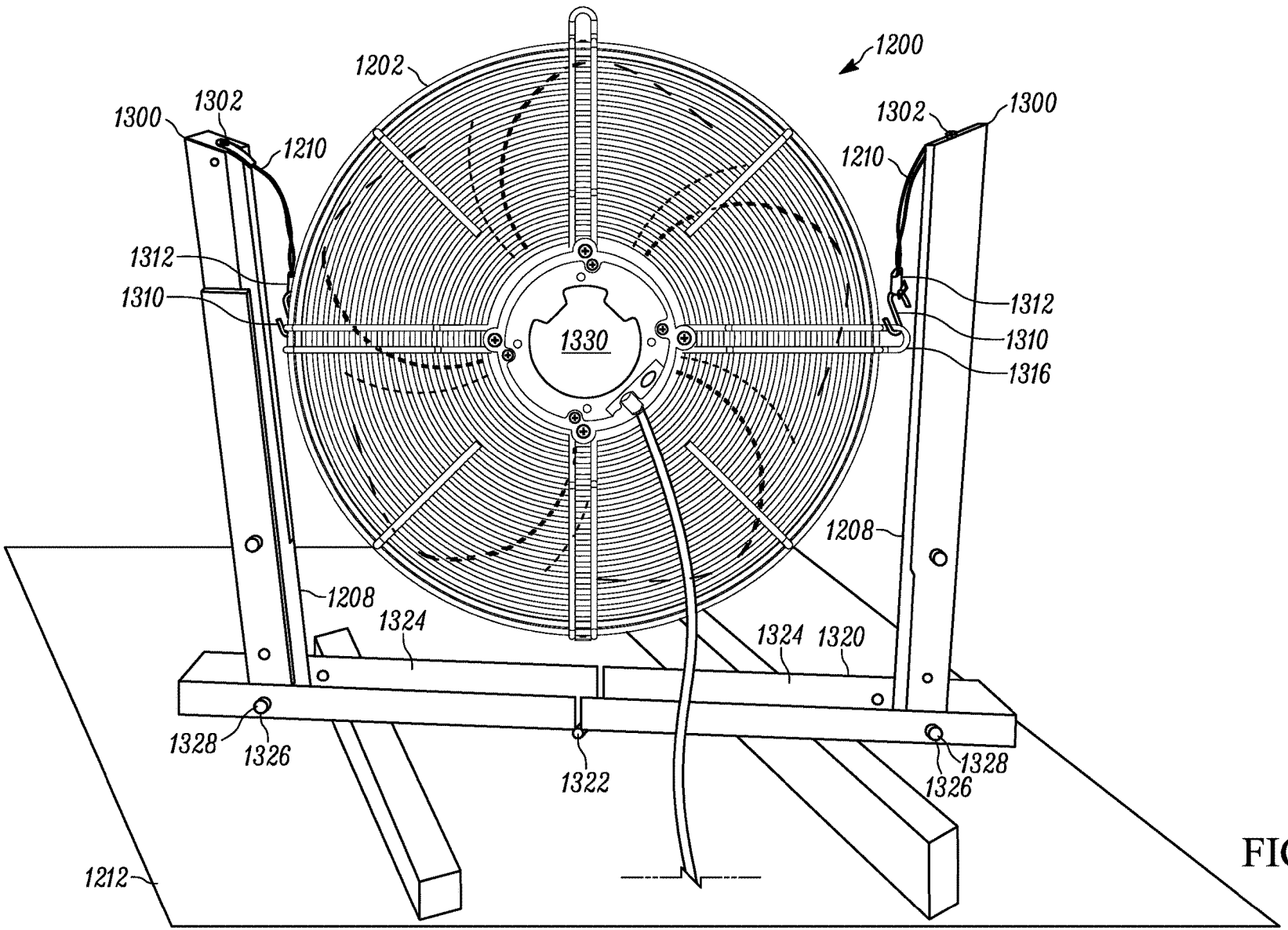
FIG. 13 is a perspective view showing non-rigid connectors in accordance with the alternate embodiment.
Figure 14:
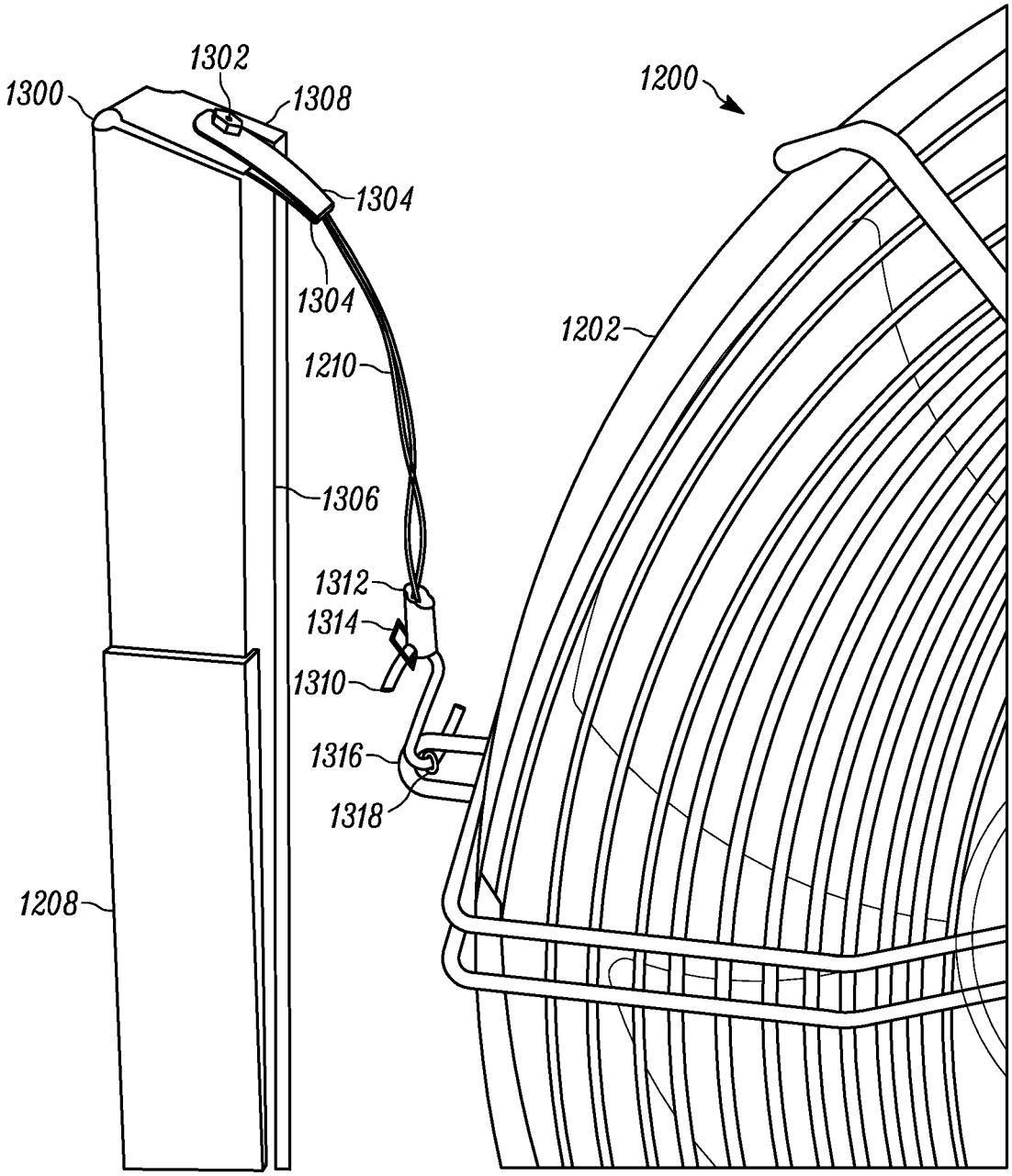
FIG. 14 is a detail perspective view of one of the non-rigid connectors.

Now in cross-reference to FIGS. 13 and 14, they show additional details according to the example embodiment described above in reference to FIG. 12, but with the damper 1204 and ducting 1206 being omitted for simplicity. As shown in FIGS. 13 and 14, in some examples the couplings 1210 may be established at least in part by non-rigid, vibration dampening connectors. The connectors may themselves be established at least in part by cylindrical cables or dual generally parallel cables, cylindrical wires or dual generally parallel wires, or straps or dual generally parallel straps that are each flat on opposing sides. Regardless, the couplings 1210 may be composed in whole or in part of metal, plastic, composite, etc., may have a powder coating, and may be used to suspend the fan housing 1202 to each strut 1208.

In the example shown in FIGS. 13 and 14, the couplings 1210 may be configured for attachment to respective top surfaces 1300 of the of the struts 1208, although the couplings may also be configured to attach to other surfaces of the struts 1208 such as upper side surfaces or upper inner surfaces. In any case, it may be appreciated from FIGS. 13 and 14 that the respective top surfaces 1300 of the struts 1208 may he oriented oblique with respect to the vertical when the struts 1208 are vertically mounted in accordance with present principles. Also, the top surfaces 1300 may include one or more bolts or other engagement members 1302 that may engage end portions of the cable, wire, or strap connectors 1210 (referred to as "straps" below for simplicity).

As may be appreciated from FIG. 14, the respective end portions of the straps 1210 that connect to the struts 1208 may each include two tabs 1304 generally converging into a "U"-shaped apex at proximal ends and generally extending distally along the longitudinal dimension of the straps 1210 in parallel to lay flush with opposing sides of the top surface 1304, e.g., a top side and a bottom side of the top surface 1304. The bottom side of the top surface 1300 may be accessible through a hollow opening 1306 in the strut 1208. The bolt 1302 and a nut (not shown) may then be used to engage the tabs 1304 with the top surface 1300 by pinching opposing outer sides of the tabs 1304 together with the bolt head and nut at the opposing sides of the top surface 1300

Furthermore, if desired resilient members such as rubber washers 1308 may be disposed on each flat side of each tab 1304 to avoid direct contact between the tabs 1304 and the top surface 1300 (on inner sides of the tabs) and between the tabs 1304 and either of the bolt head or nut (on outer sides of the tabs). Additionally, or alternatively, rubber grommets may be used where the hole in each tab 1304 may wrap around the outside of the relatively smaller narrow middle portion of the grommet and the bolt may extend through the center of the grommet itself to engage the tab 1304 with the strut 1208. In either case, in embodiments where the tabs 1304 are composed of metal for example, direct metal-to-metal contact between the tabs 1304 and top surface 1300 may be avoided, as well as direct metal-to-metal contact between the tabs 1304 and either the bolt head or nut.

However, note that in other embodiments, only a single tab may be used rather than tabs extending distally in parallel. The single tab may attach to either of the top side or bottom side of the top surface 1300 or to another upper portion of the strut, with a resilient member 1308 such as a rubber washer or grommet interposed therebetween similar to as described above.

Still in reference to FIGS. 13 and 14, respective opposite ends of the straps 1210 than the ends connecting to the struts 1208 may engage the fan housing 1202 via respective metallic S-clips 1310 to suspend the fan housing 1202 from the struts 1208 (with the fan housing 1202 also supporting the motor 1330 of the fan as also shown in FIG. 13). Thus, each of these opposite ends of the straps 1210 may include an attachment member 1312 best shown in FIG. 14. The attachment member 1312 may have a hole in it through which one end of the S-clip 1310 may be fed until a bend in the S-clip 1310 is located in the hole. The other end of the S-clip 1310 may be fed through a respective side ear 1316 on the housing 1202 that may be substantially identical in configuration and operation to the ears 214 described above.

Furthermore, in some examples a resilient member 1314 such as a rubber grommet may be used as a contact buffer between a respective S-clip 1310 and respective strap 1210. Thus, the resilient member 1314 may be incorporated into or positionable into the hole of the respective attachment member 1312 as a grommet or other vibration-dampening structure (e.g., rubber ring) so that the respective S-clip 1310 is fed through the grommet or other resilient structure 1314 to thus engage the S-clip 1310 with the strap 1210.

As indicated above, the other bend or hook of the S-clip 1310 may be positioned to engage the ear 1316 and, in so doing, an additional resilient member 1318 may be positioned between the contact point for the bend or hook of the respective S-clip and the reciprocal contact point for the respective ear 1316 itself. For example, a rubber grommet may be placed in the ear 1316 similar to the rubber grommet 216 being received within the respective ear 214 as described above, and/or the ear 1316 may be lined or coated with rubber to establish the resilient member 1318. Additionally, or alternatively, a rubber ring or liner to establish one of the resilient members 1318 may be positioned on the S-clip itself and circumscribe a segment of the S-clip 1310 establishing its contact point with the ear 1316.

Now specifically in reference to FIG. 13, in some examples the struts 1208 may be vertically mounted to a crossbar 1320 as shown. The crossbar 1320 may then be supported on structure 1212 of the ceiling/attic floor, e.g., with screws and with a flat rubber sheet or other sound-dampening structure interposed between the bottom of the crossbar 1320 that would otherwise contact portions of the ceiling/attic floor and the ceiling/attic floor itself. The struts 1208 may thus be vertically mounted to the ceiling/attic floor via the crossbar 1320 in some examples, rather than via the lower couplings 1214 as described above.

In some examples, the crossbar 1320 may even include a centrally located joint 1322 at which opposing portions of the crossbar 1320 may be folded, e.g., for packaging and transportation. The joint 1322 may be a male/female mechanical hinge with reciprocal components on each side of the joint 1322. The joint also be established by a revolute or pin joint or another type of joint such as a living hinge. In any case, in extended form as shown when mounted to a ceiling or attic floor, the crossbar 1320 may span, e.g., sixteen or twenty-four inches on center beams of the ceiling/attic floor perpendicular to the beams, or at another angle to achieve desired fan direction.

If desired, the crossbar 1320 may even include one or more openings 1324 into which the struts 1208 may be folded from respective pivot points. As best shown in FIG. 13, each pivot point may be established by a screw 1328 that extends through screw holes 1326 on each side wall of the crossbar 1320 and that extends through respective holes on each side wall of an end portion of the strut 1208 (not shown in the perspective of FIG. 13) when aligned with the holes 1326 inside the opening 1324 of the crossbar 1320.

Figure 15:
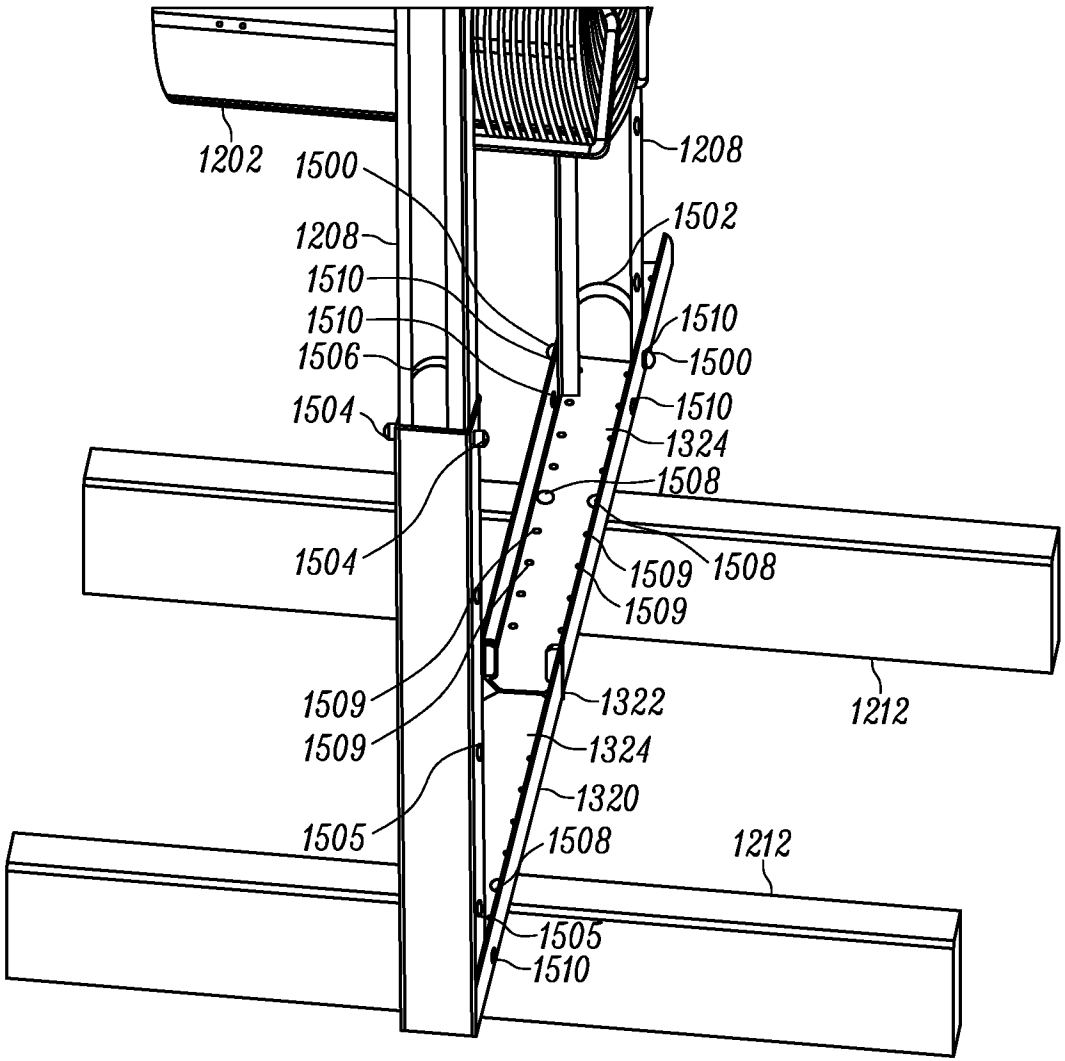
FIG. 15 shows a detailed perspective view of example struts and a crossbar that mounts the struts to structure of a ceiling.

Additionally, or alternatively, opposing spring-biased push buttons 1500 may be used instead of the screws 1328, as shown in the alternate example of FIG. 15. As also shown in FIG. 15, each push button 1500 may be mounted on a respective strut 1208 and may be pushed outward from inside the opening 1324 under bias of a respective arc spring 1502 (or other type of spring) and out of a respective hole 1510 in a side wall of the crossbar 1320 to engage the strut 1208 with the crossbar 1320. Thus, in this example a person may push each button 1500 inward against spring bias and through a side wall hole 1510 of the crossbar 1320 to move each strut 1208 to a different crossbar location also with holes 1510, as will be described further below.

In any case, note in terms of the example shown in FIGS. 13 and 14 that the struts 1208 may be adjusted to appropriate length to be folded into the opening 1324. The length of the struts 1208 may be adjusted similar to as set forth above with respect to the first and second configurations and set pin of FIGS. 7 and 8.

However, also note that opposing spring-biased push buttons 1504 as shown in FIG. 15 may also be used to adjust the length of each strut 1208, e.g., to appropriate length for folding into the opening 1324. In such examples, the length may be adjusted by pushing each button 1504 as mounted on an inner segment of the strut 1208 against bias of an arc spring 1506 (or other type of spring) toward the inner segment of the strut 1208 and through a respective hole 1505 of an outer segment of the strut 1208 from which the button 1504 might already protrude. The length of the strut 1208 may then be adjusted and the spring bias of each button 1504 may be allowed to push each button 1504 back out through another hole 1505 formed in the strut's outer segment to hold the strut at a desired length.

In either case, once folded into the openings 1324 shown in both of FIGS. 13 and 15, the struts 1208 may lay flush with the profile of the crossbar 1320.

Now further describing FIG. 15 in particular and for completeness, as shown the crossbar 1320 may be mounted to the structure 1212 of the ceiling via screws 1508 extending through one or more holes 1509 of a bottom surface of the crossbar 1320.

Also note that multiple sets of holes 1510 may be disposed on side walls of the crossbar 1320 at various transverse sections of the crossbar 1320. Each set of holes 1510 may be used to adjust where the struts 1208 engage the crossbar 1320 for mounting to the structure 1212. Thus, different sets of the holes 1510 that are located along same transverse segments of the crossbar 1320 at a same height but on opposing side walls may be used for mounting the struts 1208 via the buttons 1500 to the crossbar 1320, depending on the particular width or diameter of the fan housing 1202. This may facilitate use of a single crossbar 1320 for use with fans and housings of different sizes so that the struts 1208 may remain mounted vertical or at least substantially vertical when the housing is suspended, rather than at an oblique angle with respect to vertical.

Figure 16:
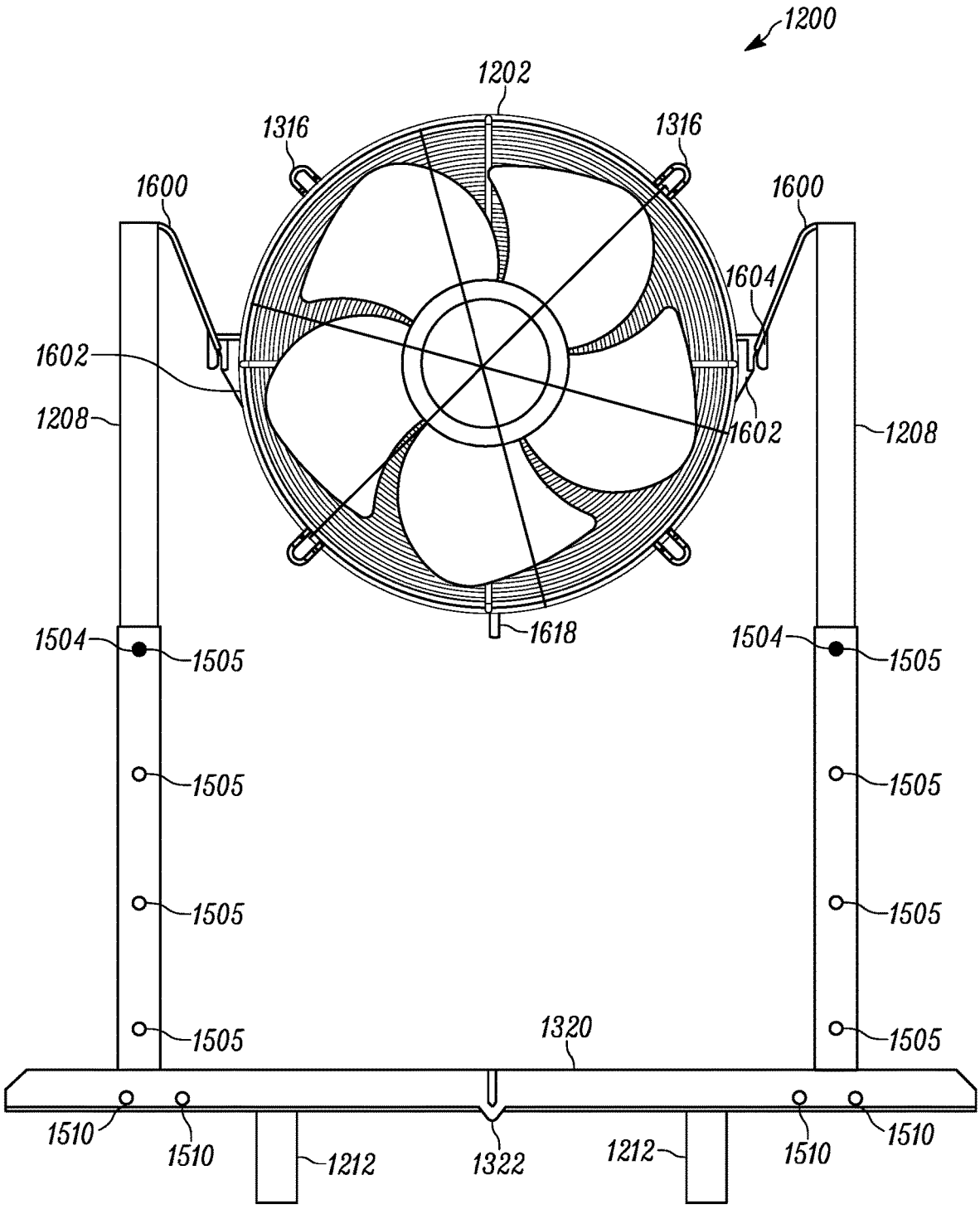
FIG. 16 shows a front elevational view of struts suspending a fan assembly via ear hooks.
Figure 17:
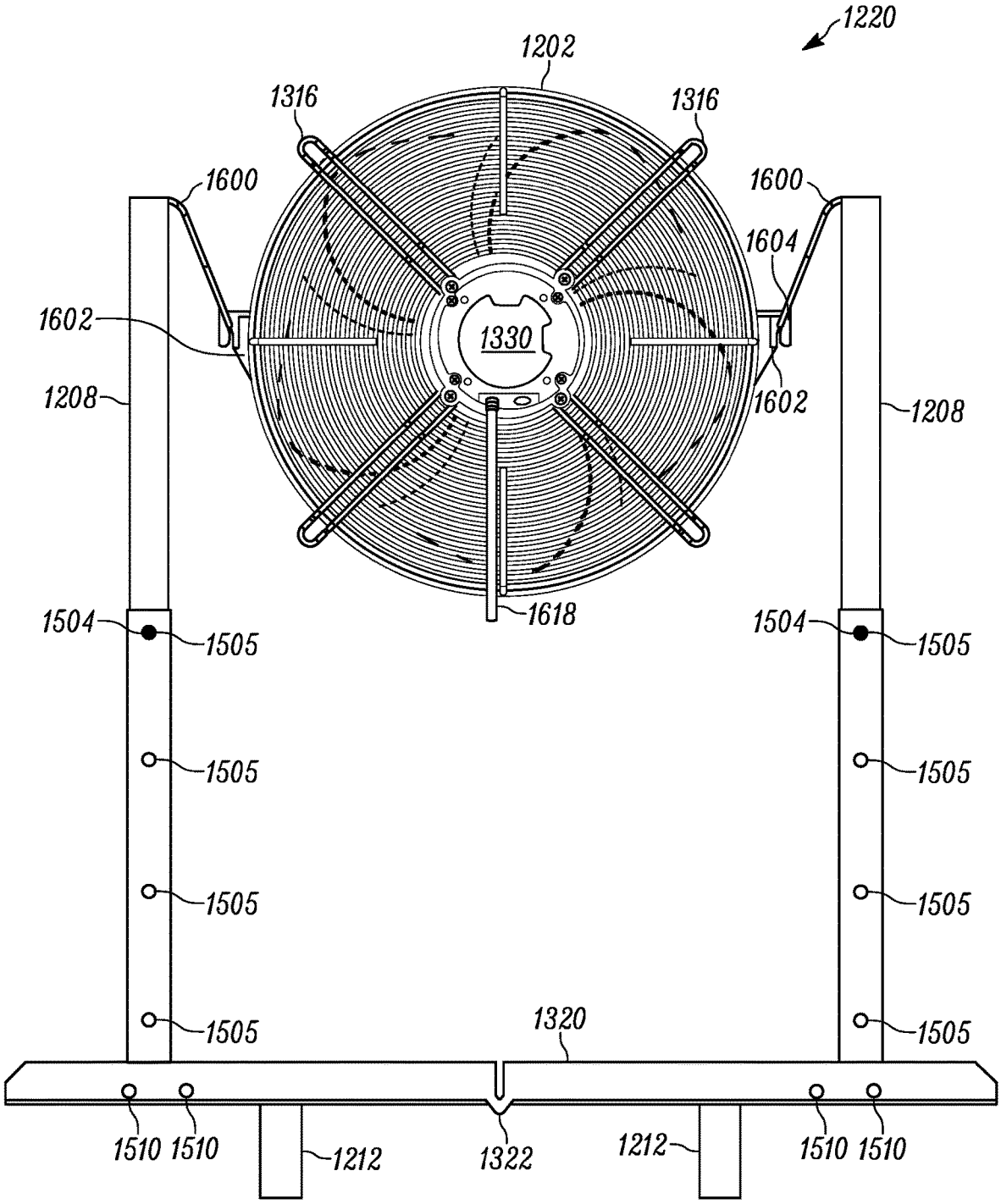
FIG. 17 shows a rear elevational view of struts suspending a fan assembly via ear hooks.
Figure 18:
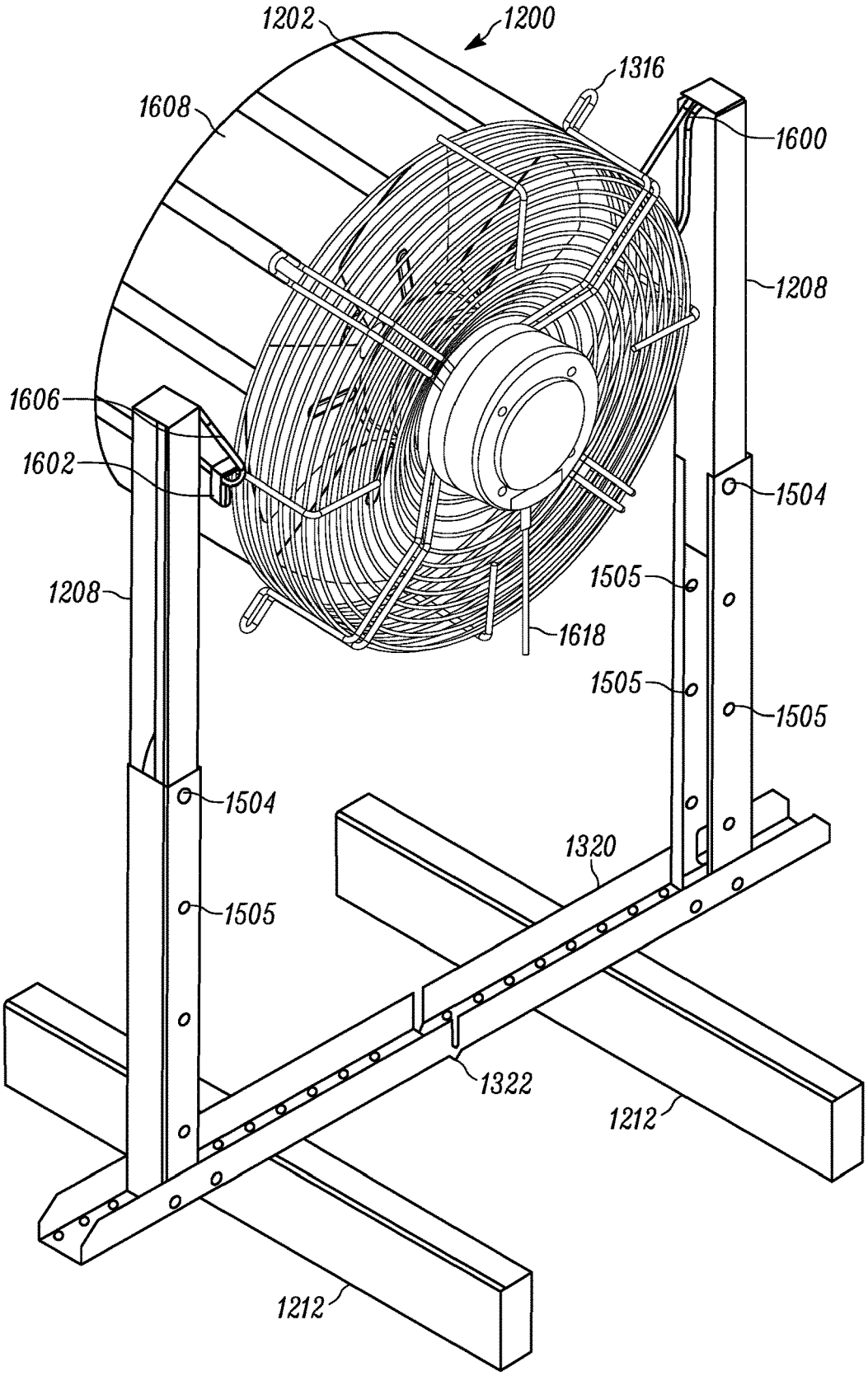
FIG. 18 shows a perspective view of struts suspending a fan assembly via ear hooks.
Figure 19:
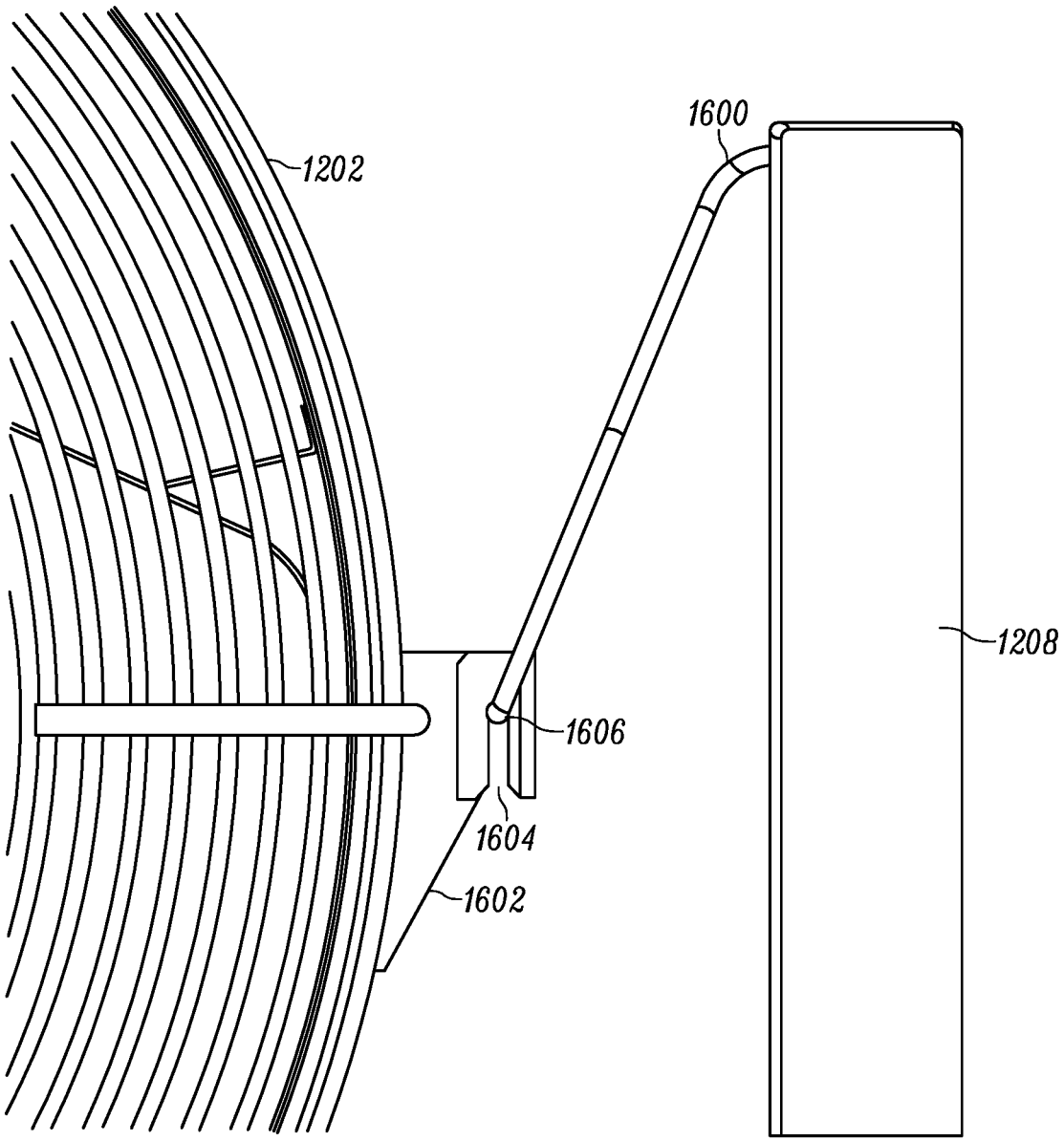
FIG. 19 shows a detailed rear elevational view of an example ear hook.
Figure 20:
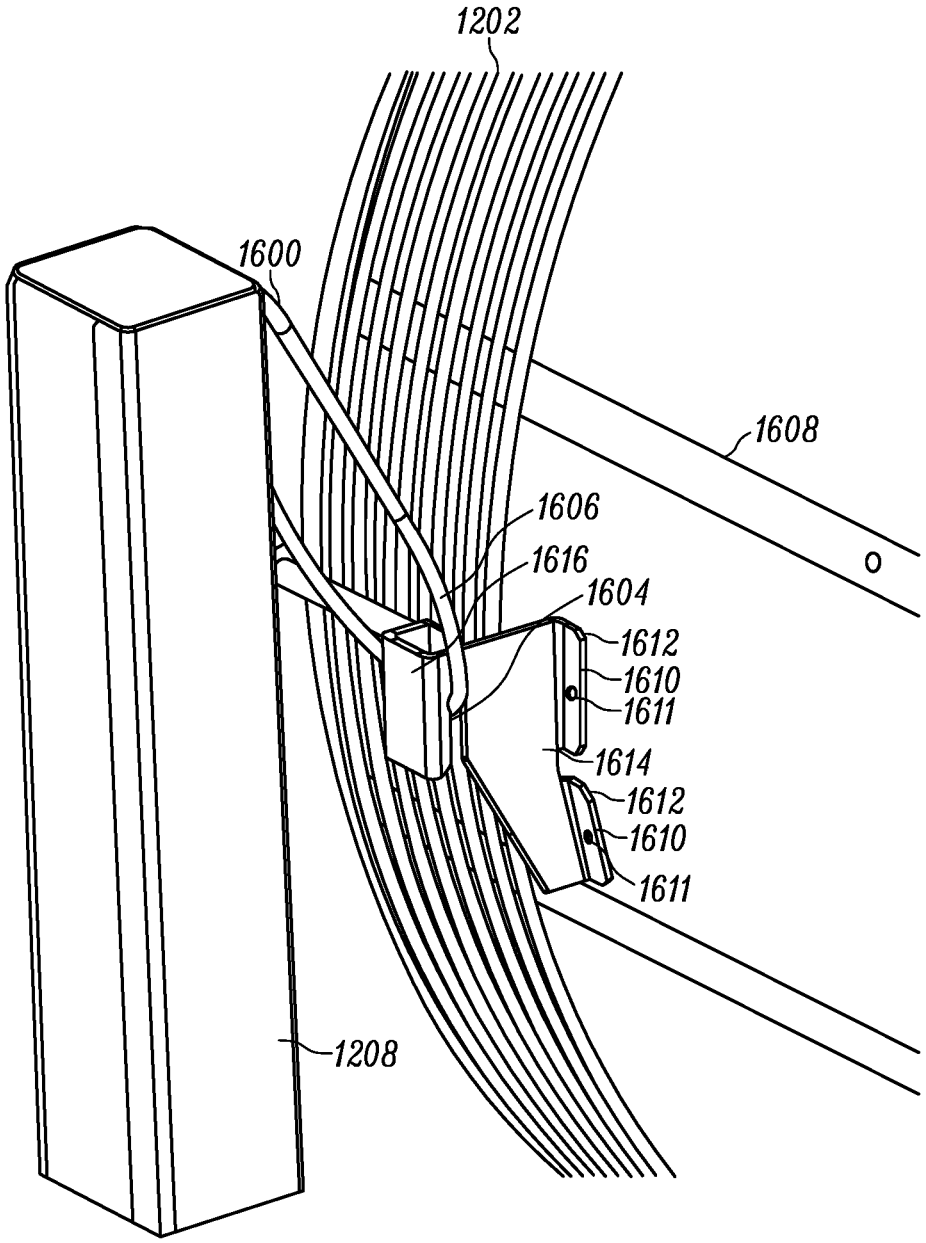
FIG. 20 shows a detailed perspective view of an example ear hook.

Now in cross-reference to FIGS. 16-20, they show an alternate way in which non-rigid connectors (connectors 1600 in these figures) may be attached to the vertically mounted struts 1208 to suspend the whole house fan assembly 1200 from the struts 1208. In this example, suspension is done in part through use of one or more ear hooks 1602 on the housing 1202. FIG. 16 shows a front elevational view of this example implementation, while FIG. 17 shows a rear elevational view and FIG. 18 shows a perspective view. FIG. 19 then shows a detailed rear elevational view of one of the ear hooks 1602, and FIG. 20 shows a detailed perspective view of one of the ear hooks 1602. Most if not all of the components of the whole house fan assembly 1200 and related structure as shown in these figures may be the same as described above save for differences noted in this paragraph and below.

As may be appreciated from FIGS. 16-20, each ear hook 1602 may be distinct from the ears 1316 located elsewhere on the housing 1202. Each ear hook 1602 may also have an opening 1604 facing or opening downward toward the crossbar 1320 so that a loop 1606 of a respective non-rigid connector 1600 may engage the ear hook 1602 via the opening 1604 to dampen sound from the fan. Gravity may hold the loop 1606 engaged with the ear hook 1602 owing to the weight of the assembly 1200 and shape of the hook 1602.

Each non-rigid connector 1600 may be established by one or more wires, cables, and/or straps made in whole or in part of metal (e.g., steel), plastic, composite, etc. Each connector 1600 may also have a powder coating and may be used to suspend the fan housing 1202 to a respective strut 1208. Moreover, as shown best in FIGS. 18 and 20, each ear hook 1602 may be disposed on a fan shroud 1608 that establishes part of the fan housing 1202 and that may be substantially similar in function and configuration to the shroud 200 described above.

As best shown in FIG. 20, each ear hook 1602 may be secured to the shroud 1608 via one or more screws 1610 that extend through holes 1611 on respective tabs 1612 of each ear hook 1602 and also that extend into screw holes in the shroud 1608 itself. The tabs 1612 may lie flush or substantially flush with the exterior surface of the shroud 1608. As also shown best in FIG. 20, each ear hook 1602 may have a segment 1614 extending perpendicularly away from the tabs 1612 and/or shroud 1608 to form part of the opening 1604 along with a distal knob 1616 that may be box-shaped (save for, e.g., a side opening facing the shroud 1608 and/or top and bottom openings) and that may also form part of the opening 1604. The distal knob 1616 may thus help establish multiple contact points of the hook 1602 at which a respective connector 1600 may engage the hook 1602.

Furthermore, as shown best in FIGS. 18 and 20, in some examples each connector 1600 may form a respective loop 1606 as one end, which may be engaged with the hook 1602, and then each connector 1600 may form another loop at its other end which may be used connect the connector 1600 to a respective strut 1208 via one or more of the ways described above (e.g., via a screw, via wrap around a grommet which itself is engaged with a screw, etc.).Alternatively, the connector 1600 may split into separate generally parallel segments as it extends from the loop 1606 to form separate terminating ends which may each engage one or more upper surfaces of the respective strut 1208 via a screw, clamp, coupling, etc. in accordance with present principles.

For completeness, also note that a portion of a power cord 1618 that connects to an electrical outlet at one end to provide power the motor 1330 at its other end is shown in FIGS. 16-18. Also, for completeness, note that in some embodiments as resilient member which may be made of rubber may be disposed between the loop 1606 and contact points of the ear hook 1604, if desired. For example, a rubber sleeve may circumscribe the loop 1606 at its contact points, and/or rubber may be molded to the ear hook 1604 itself at points that contact the loop 1606. Further still, resilient members may also be used for where the connectors 1600 engage the struts 1208 similar to as set forth in other examples above (e.g., using a rubber grommet).

Present principles discussed above allow for isolation or dampening of vibration while improving ease of installation, solving installation problems in high attics. Furthermore, present principles facilitate creating a pitch angle on the fan to improve air flow through the duct that cannot be created with a hanging fan, while achieving the same or lower quietness as a hanging fan.

While the particular device is herein shown and described in detail, it is to be understood that the subject matter which is encompassed by the present invention is limited only by the claims.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

What is claimed is:

1. An assembly, comprising:

at least one fan housing;

at least one fan mounted in the fan housing;

at least one intake plenum configured to be mounted on at least one structure of a ceiling in a building above an opening of the ceiling;

at least one air duct configured for connecting the fan housing to the intake plenum such that the fan when energized can draw air in through the opening of the ceiling, the intake plenum, and the duct and exhaust air into an attic of the building; and at least one strut configured for vertical mounting on structure of the ceiling at a lower end of the strut and to the fan housing at an upper end of the strut such that the fan housing is not suspended from a rafter and is mounted, when installed in a building, to the ceiling by the at least one strut.

2. The assembly of claim 1, wherein the air duct is flexible, and wherein the air duct has a first end connectable to the intake plenum and a second end connectable to the fan housing so that the fan when connected to the air duct draws air in the building through the intake plenum and duct and exhausts the air in the attic.

3. The assembly of claim 1, comprising:

a sound dampener interposed between the at least one strut and the fan housing, and/or interposed between the at least one strut and structure of the ceiling to which the at least one strut is mounted.

4. The assembly of claim 1, comprising:

at least first and second struts, each of the first and second struts being configured for vertical mounting to structure of the ceiling at least a first non-rigid connector configured for attachment to the first strut and to the fan housing to suspend the fan housing from the first strut; and at least a second non-rigid connector configured for attachment to the second strut and to the fan housing to suspend the fan housing from the second strut.

5. The assembly of claim 4, comprising:

a first ear hook configured for attachment to the fan housing and configured for connection, via the first non-rigid connector, to the first strut; and a second ear hook configured for attachment to the fan housing and configured for connection, via the second non-rigid connector, to the second strut.

6. The assembly of claim 4, comprising:

at least one crossbar configured for horizontal mounting on structure of the ceiling and configured to vertically mount the first and second struts on structure of the ceiling.

7. An assembly comprising:

an intake plenum mountable over an opening in a ceiling of a building to be supported on one or more ceiling beams in an attic of the building;

a flexible duct having a first end connectable to the intake plenum and a second end connectable to a housing of a fan, so that the fan when connected to the duct draws air in the building through the intake plenum and duct and exhausts the air into the attic;

at least one strut configured for vertical connection to a ceiling beam or support surface at a lower end of the strut and to the housing of the fan at an upper end of the strut; and a sound dampener interposed between the strut and the fan housing, and/or between the strut and the ceiling beam or support surface to which the strut is attached.

8. The assembly of claim 7, wherein the strut comprises a first segment and a second segment slidably engaged with the first segment in a first configuration and not slidably engaged with the second segment in a second configuration.

9. The assembly of claim 8, wherein the second segment comprises a U-shaped channel configured for receiving the first segment.

10. An assembly, comprising:

at least one fan coupled to a fan housing;

at least one intake plenum configured to be mounted on at least one structure of a ceiling in a building above an opening of the ceiling;

at least one air duct configured for connecting the fan housing to the intake plenum such that the fan when energized can draw air in through the opening of the ceiling, the intake plenum, and the duct and exhaust air into an attic of the building;

at least a first strut configured for vertical mounting on structure of the ceiling;

at least a first non-rigid connector configured for attachment to the first strut and to the fan housing to suspend the fan housing from the first strut;

at least a second strut configured for vertical mounting on structure of the ceiling; and at least a second non-rigid connector configured for attachment to the second strut and to the fan housing to suspend the fan housing from the second strut.

11. The assembly of claim 10, wherein the first and second non-rigid connectors are configured for attachment to the fan housing via respective ear hooks coupled to the fan housing.

12. The assembly of claim 11, wherein each of the first and second non-rigid connectors are configured to establish a loop that engages a respective ear hook coupled to the fan housing.

13. The assembly of claim 10, comprising:

a crossbar configured for mounting on structure of the ceiling and configured to vertically mount the first and second struts on structure of the ceiling.

14. The assembly of claim 5, wherein the ear hooks are secured to a fan shroud that establishes a part of the fan housing.

15. The assembly of claim 14, wherein each ear hook comprises a respective tab, and each ear hook is secured to the shroud by at least one respective fastener extending through the respective tab and into the shroud.

16. The assembly of claim 15, wherein the tabs are substantially flush with an exterior surface of the shroud.

17. The assembly of claim 15, wherein each ear hook comprises:

a respective segment extending from the respective tab and/or shroud and a respective box-shaped structure to establish multiple contact points of the respective ear hook at which a respective connector may engage the respective ear hook.

18. An assembly comprising:

a fan housing supporting a fan;

first and second struts;

first and second non-rigid connectors each comprising a first end connectable to the fan housing and a second end connectable to the respective first or second strut, whereby the fan housing is suspended between the struts by the connectors when installed in an attic with the struts vertically oriented and resting on respective bottom ends with the second ends of the connectors elevated above the first ends of the connectors.

* * * * *